US006481984B1

(12) United States Patent
Shinohara et al.

(10) Patent No.: US 6,481,984 B1
(45) Date of Patent: Nov. 19, 2002

(54) PUMP AND METHOD OF DRIVING THE SAME

(75) Inventors: Jun Shinohara, Chiba (JP); Masayuki Suda, Chiba (JP); Kazuyoshi Furuta, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/696,789

(22) Filed: Oct. 26, 2000

(30) Foreign Application Priority Data

Oct. 27, 1999 (JP) ..... 11-305246
Sep. 18, 2000 (JP) ..... 2000-282234

(51) Int. Cl.[7] ..... F04B 17/00

(52) U.S. Cl. ..... 417/413.2; 417/53; 417/479; 417/521

(58) Field of Search ..... 417/53, 413.2, 417/413.3, 479, 521, 533

(56) References Cited

U.S. PATENT DOCUMENTS 4,648,807 A * 3/1987 Tippetts et al. ..... 417/322
5,192,197 A * 3/1993 Culp ..... 417/322
5,759,015 A * 6/1998 Van Lintel et al. ..... 417/322
5,836,750 A * 11/1998 Cabuz ..... 417/322
6,247,908 B1 * 6/2001 Shinohara et al. ..... 417/413.2
6,261,066 B1 * 7/2001 Linnemann et al. ..... 417/53

FOREIGN PATENT DOCUMENTS

DE 4143343 A1 * 3/1993
JP 410274164 A * 10/1998
JP 411257231 A * 9/1999
NL 134614 A * 3/1985

* cited by examiner

*Primary Examiner*—Charles G. Freay
*Assistant Examiner*—Han L. Liu
(74) *Attorney, Agent, or Firm*—Adams & Wilks

(57) ABSTRACT

A pump comprises a first substrate having a fluid inlet port for receiving a fluid, a fluid outlet port for discharging the fluid, a first pumping section for pumping the fluid from the fluid inlet port to the fluid outlet port, a first inlet valve section disposed between the fluid inlet port and the first pumping section, and a first outlet valve section disposed between the fluid outlet port and the first pumping section. A second substrate has a second pumping section, a second inlet valve section, and a second outlet valve section. An intermediate substrate is disposed between the first and second substrates to form a first fluid feeding path and a second fluid feeding path for feeding the fluid pumped by the first and second pumping sections. The first fluid feeding path extends from the first inlet valve section to the first outlet valve section through the first pumping section. The second fluid feeding path extends from the second inlet valve section to the second outlet valve section through the second pumping section. The intermediate substrate has a first connection port connecting the first and second inlet valve sections in fluid communication with the fluid inlet port and a second connection port connecting the first and second outlet valve sections in fluid communication with the fluid outlet port.

16 Claims, 15 Drawing Sheets

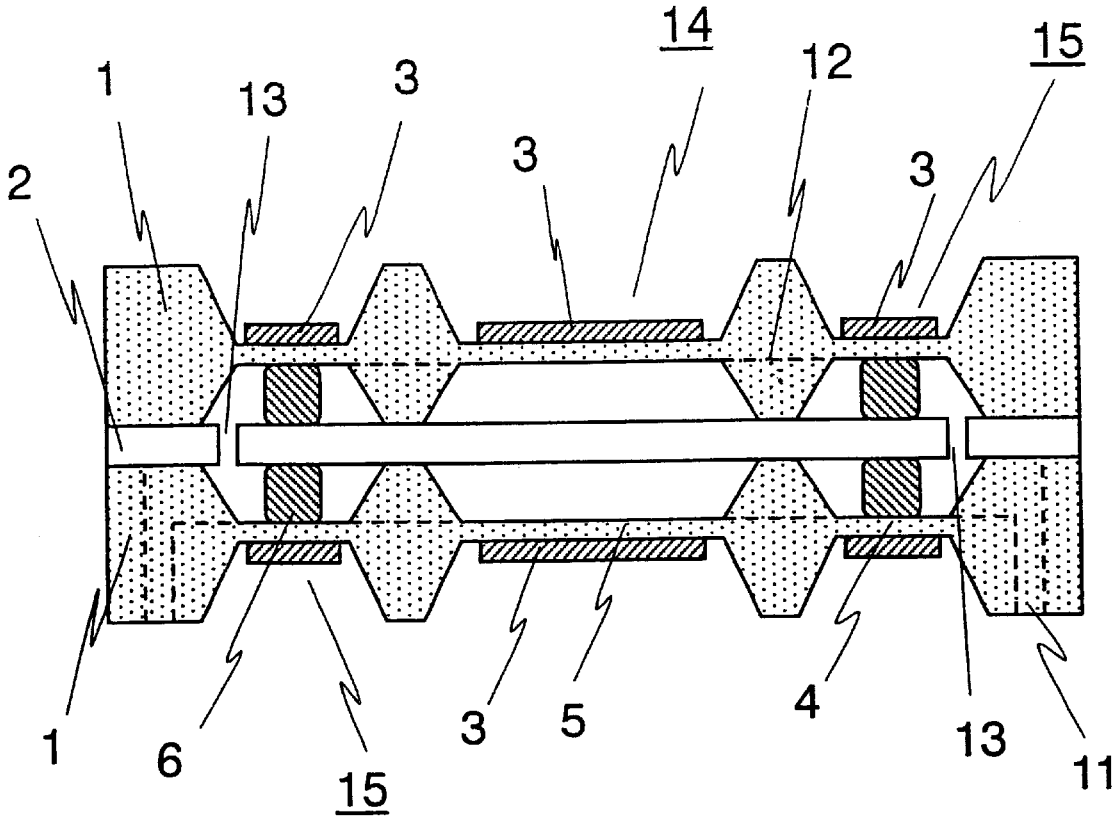
FIG. 1
FIG. 2
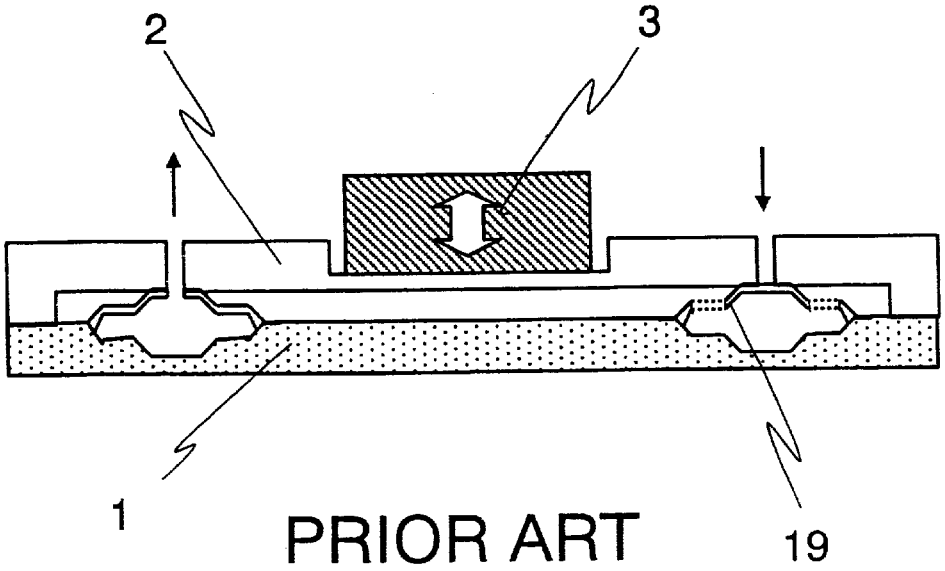
PRIOR ART

PRIOR ART

FIG. 14
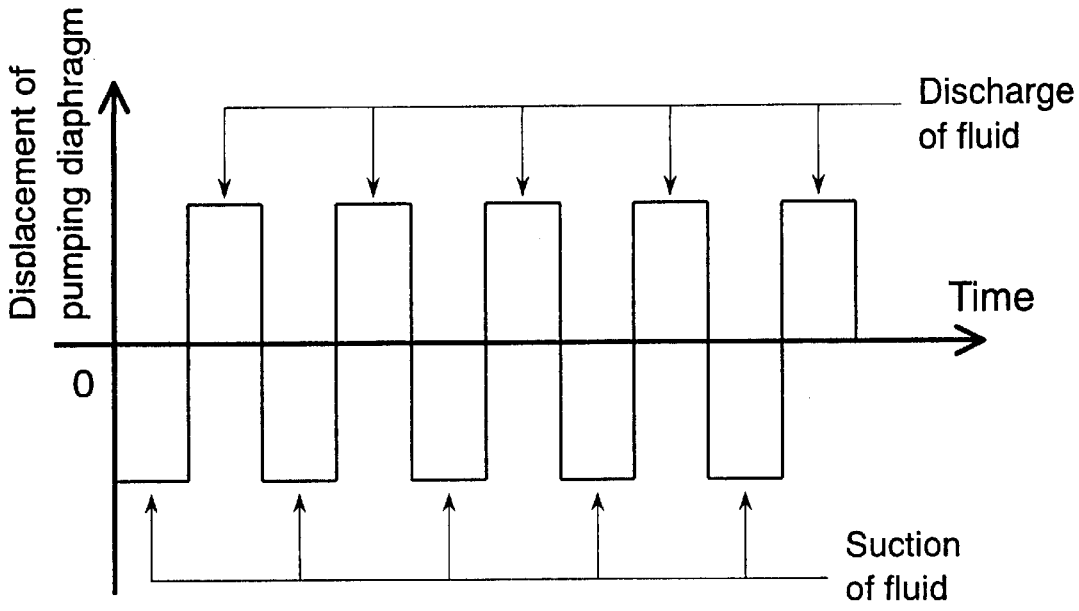
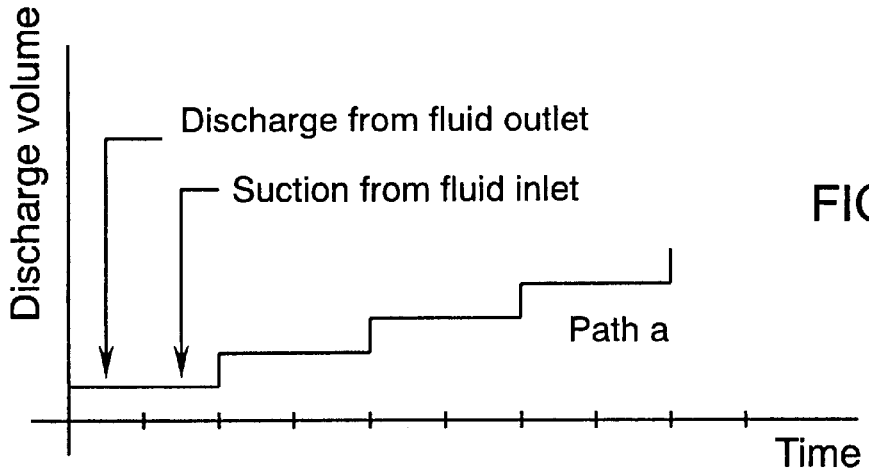
FIG. 15A
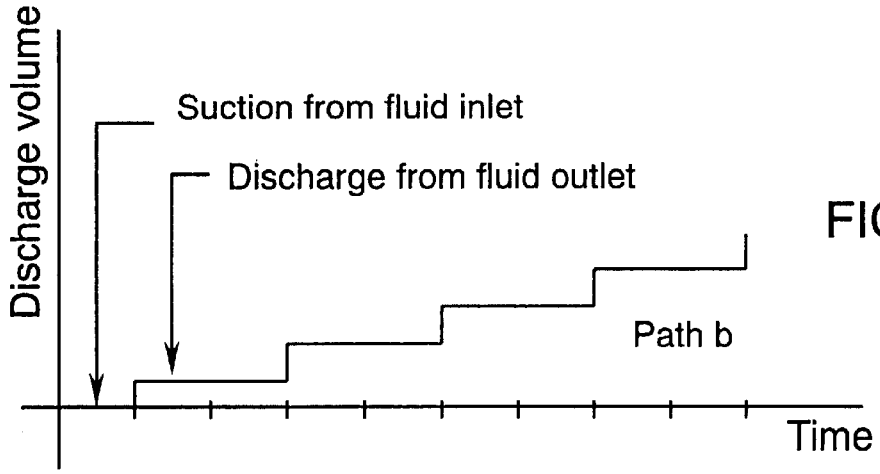
FIG. 15B

FIG. 17
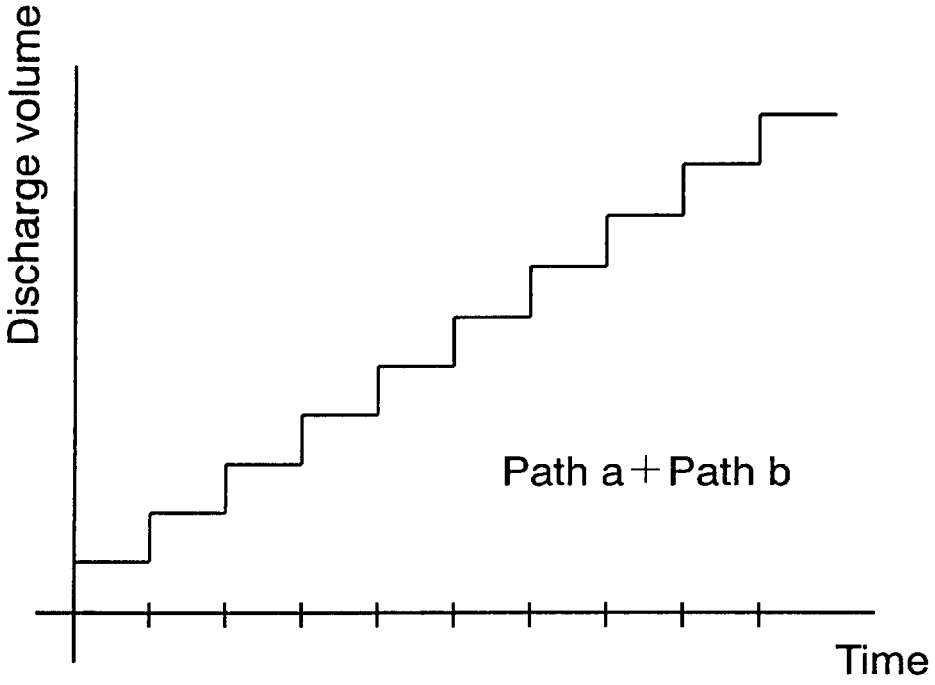
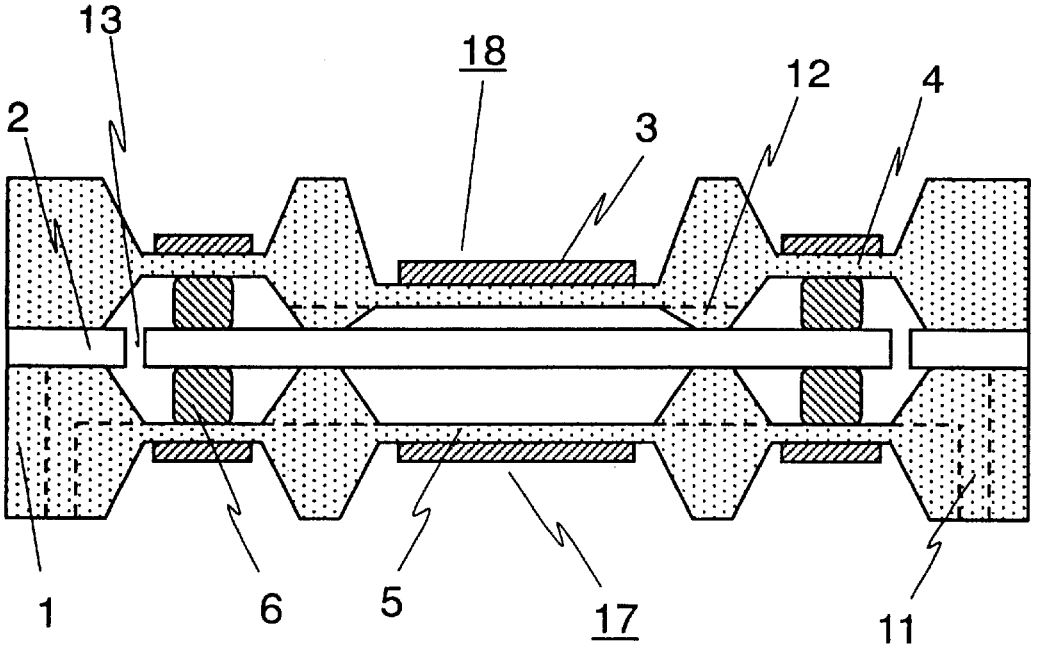
FIG. 18

FIG. 23

| Flow rate | Selection Path |
|---|---|
| 1 micro liter / cycle | A |
| 2 micro liter / cycle | B |
| 3 micro liter / cycle | A+B |
| 4 micro liter / cycle | C |
| 5 micro liter / cycle | A+C |
| 6 micro liter / cycle | B+C |
| 7 micro liter / cycle | A+B+C |
| 8 micro liter / cycle | D |
| 9 micro liter / cycle | A+D |
| 10 micro liter / cycle | B+D |
| 11 micro liter / cycle | A+B+D |
| 12 micro liter / cycle | C+D |
| 13 micro liter / cycle | A+C+D |
| 14 micro liter / cycle | B+C+D |
| 15 micro liter / cycle | A+B+C+D |

A : 1 micro liter / cycle

B : 2 micro liter / cycle

C : 4 micro liter / cycle

D : 8 micro liter / cycle

PUMP AND METHOD OF DRIVING THE SAME

BACKGROUND OF THE INVENTION

The invention relates to a micropump and a microvalve which are small in size and are used in the medical field and analysis field for performing fluid control with high accuracy.

Conventionally, small-sized pumps for performing fluid control with high accuracy include, for example, a micropump described in Japanese Patent Laid-Open No. 1669/1993 and shown in FIG. 2, in which case a thin film 19 of metal or polysilicon is formed on a sacrificing layer of oxide film on a silicon substrate 1, and the sacrificing layer is removed by etching to provide a check valve of metal or polysilicon to provide a pump by a piezoelectric element 3 provided on a glass substrate 2.

Also, with a pump described in Japanese Patent Laid-Open No. 072270/1997 and shown in FIG. 3, a silicon substrate 1 having valve diaphragms 4 is joined to a glass substrate 2 and packings 6 are formed on valve seats 7 formed on the valve diaphragms 4. Voltage is applied on piezoelectric elements 3 disposed on the valve diaphragms 4 to deform the valve diaphragms 4 for opening and closing of valves on liquid inlet and outlet.

Also, a pump described in Japanese Patent Laid-Open No. 66784/1992 and shown in FIG. 4 is constructed such that two valves 7, respectively, serve as a one-way valve depending upon the positional relationship between the valves and fluid inlet and outlet 11. Therefore, liquid feeding is realized in one direction by applying voltage on a piezoelectric element 3 in a central portion for generation of volume change in the pump.

The above-mentioned pumps involve several problems. In the case of the pump construction shown in FIGS. 2 to 4, there has been the necessity of increasing an amount of volume change in pumping sections or drive frequency thereof in order to increase an amount of liquid feeding.

For the purpose of increasing an amount of volume change, a way to increase amounts of displacement for pumping diaphragms is conceivable, but since amounts of displacement of pumping diaphragms depend on amounts of displacement of actuators, it is not easy to increase such amounts of displacement while actuators of the same kind are used. Also, there is contemplated a way to increase such amounts of displacement by increasing an area of a pumping diaphragm, in which case there is caused a problem that a pump will become large in size and simultaneously pulsating flows will become large at the time of liquid feeding. Also, there is caused a problem that accuracy is degraded at the time of liquid feeding for a small amount.

Meanwhile, in the case where a pump is made small in size, a range, in which flow rate can be adjusted by drive frequency, is restricted since an increase in flow rate is not produced above a predetermined frequency due to that viscous resistance, which is generated when a fluid moves in the pump. Also, the pump shown in FIG. 2 or 4 is constructed in such a manner to use two one-way valves, and so involves a problem that a highly accurate adjustment of flow rate is difficult since flow generates toward an outlet side from an inlet side, in particular, when pressure acts in a forward direction toward the outlet side from the inlet side.

Also, with the construction of conventional pumps, the discharge volume per cycle is constant at all times and so fixed in flow rate. Therefore, there is caused a problem that the entire system is complex since it is necessary to use a voltage varying mechanism to change voltage supplied to actuators from a voltage source depending upon the driving condition when the discharge volume is to be modified.

SUMMARY OF THE INVENTION

The invention solve the foregoing problems in the conventional art pump of the invention, two substrates, the same substrate being formed with an inlet side valve section, a pumping section and an outlet side valve section, are joined to both surfaces of an intermediate substrate, and flow passages are provided to connect between a fluid inlet and two inlet side valves on the both surfaces of the intermediate substrate and between a fluid outlet and two outlet side valves on the both surfaces of the intermediate substrate. By the foregoing construction, two separate liquid feeding paths are formed on both surfaces of the intermediate substrate. Also, the two inlet side valves and the two outlet side valves are active valves, which can be opened and closed optionally by actuators and are constructed to be capable of being closed even in a state in which energy is not supplied. Therefore, liquid feeding can be performed with high accuracy without being affected by pressure changes outside the pump.

Further, with a method of driving a pump having the foregoing construction, a range of selectable flow rate can be enlarged while maintaining the same accuracy of flow rate as that of the prior art by using either of two liquid feeding paths in the case of a small flow rate and using [the] both liquid feeding paths simultaneously or at an optional timing in the case of a large flow rate.

Also, pulsating flows can be reduced at the time of liquid feeding provided that timing for liquid feeding in the two liquid feeding paths is appropriately selected.

Also, volumes of the pumping sections disposed on the both surfaces of the intermediate substrate and thicknesses of the diaphragms are made different from each other, then it is possible to change flow rate without a change in voltage applied to the actuators, that is, without the use of any special voltage varying mechanism.

BRIEF DESCRIPTION OF THE DRAWINGS

FIG. 1 is a cross sectional view showing a construction of a pump according to the invention;

FIG. 2 is a cross sectional view showing a construction of a prior pump;

FIG. 14 is a graph indicating a change in displacement of a diaphragm with time;

FIG. 15A is a graph indicating discharge in the path a;

FIG. 15B is a graph indicating discharge in the path b;

FIG. 17 is a graph indicating discharge when two paths are used;

FIG. 18 is a cross sectional view showing a construction of a pump having pumping sections, which are different in volume;

FIG. 23 is a table indicating an amount of liquid feeding per cycle in combinations of liquid feeding paths.

DETAILED DESCRIPTION OF THE PREFERRED EMBODIMENTS

An explanation will be given to a constitution of a pump according to the invention. With the pump according to the invention, first and second substrates formed with a pumping section, which includes pumping actuators and pumping diaphragms, and with an inlet side valve section, which includes valve actuators and valve diaphragms, are joined to both surfaces of an intermediate substrate in such a manner to face each other with the intermediate substrate therebetween. Further, packings are provided between the valve diaphragms and the intermediate substrate to enable blocking movements of a fluid, and the valves are always closed in a state, in which the actuators are not driven with such constitution, two separate liquid feeding paths are provided on both sides of the intermediate substrate. Therefore, it is possible to realize making an amount of liquid feeding per unit time two times larger without an increase in size of the pump.

Embodiments of the invention will be described below with reference to the drawings.

Embodiment 1

A construction of a pump according to an embodiment 1 will be described, in which a glass substrate is used as an intermediate substrate and silicon substrates are used as substrates being joined to both surfaces of the intermediate substrate and which comprises valve diaphragms and a pumping diaphragm on the silicon substrates, packings on the valve diaphragms and connection ports provided in the glass substrate for connection of two valve sections.

Figure 3:
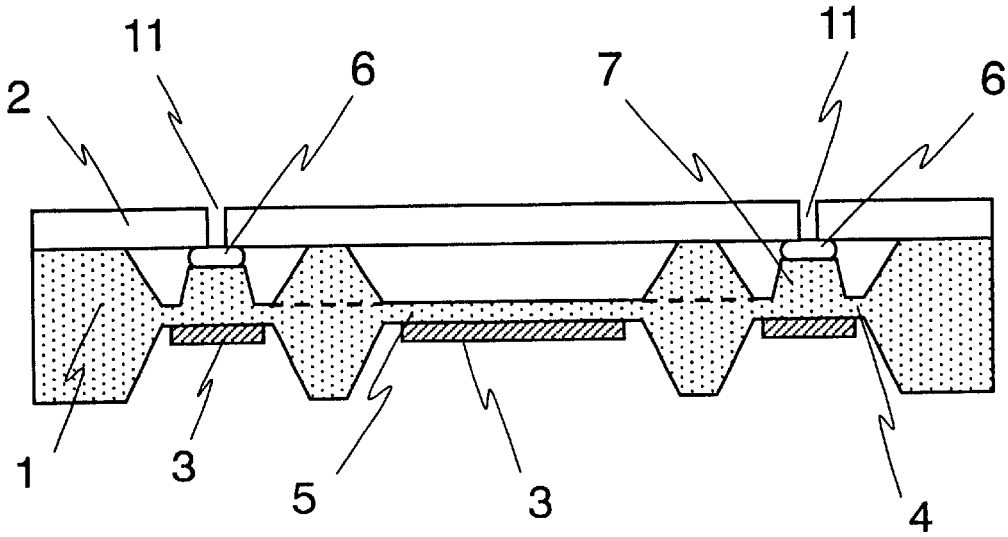
FIG. 3 PRIOR ART
FIG. 3 is a cross sectional view showing a construction of a prior pump.
Figure 4:
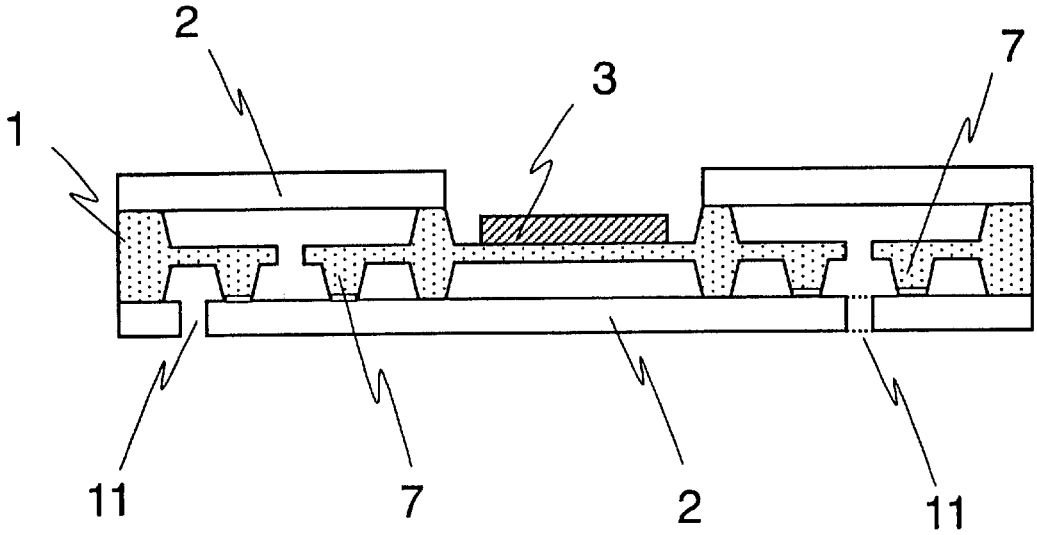
FIG. 4 is a cross sectional view showing a construction of a prior pump.
Figure 5:
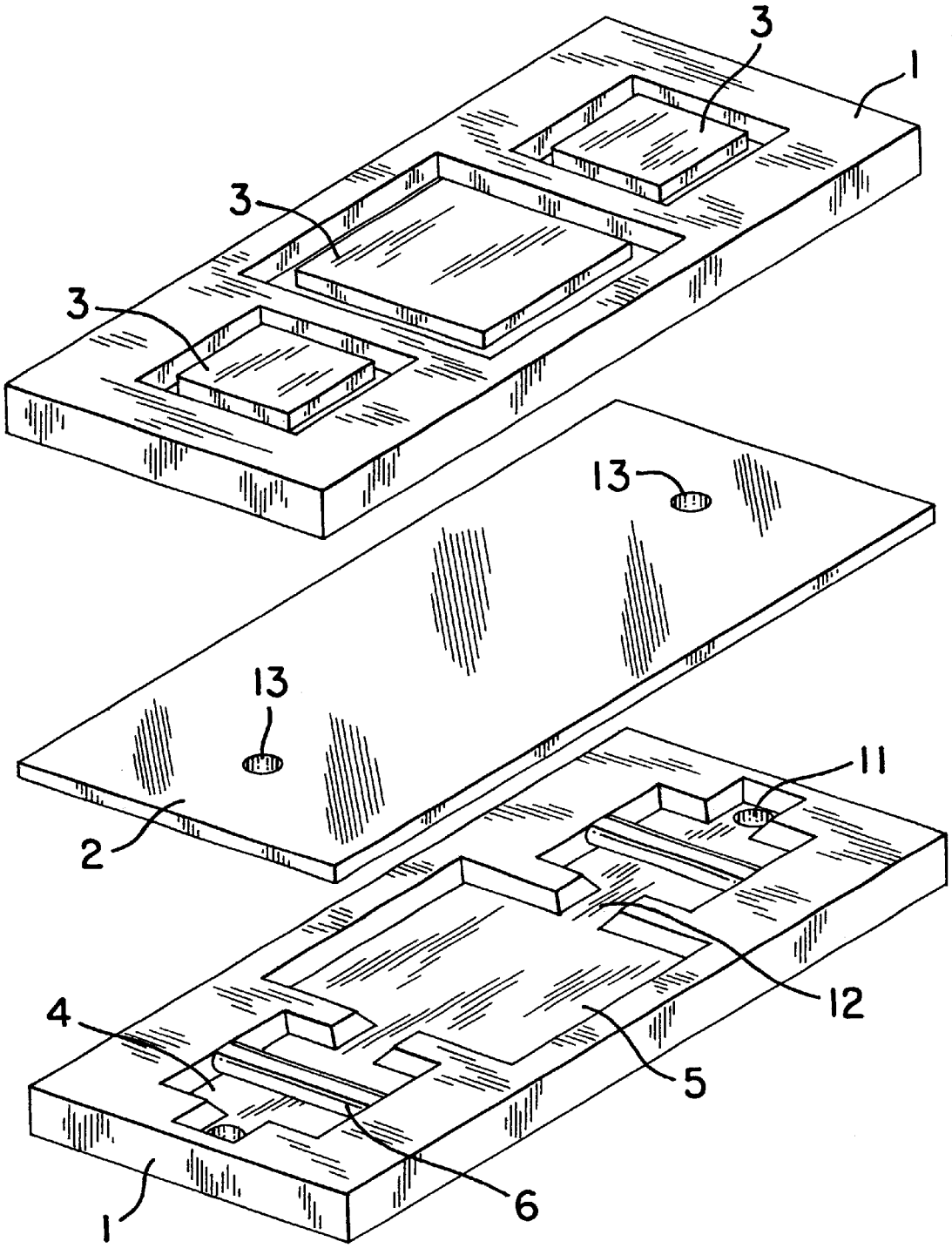
FIG. 5 is an exploded view showing a construction of a pump according to the invention.

FIG. 1 is a cross sectional view showing an example of a pump construction according to the invention, and FIG. 5 is an exploded view showing the pump construction. Two silicon substrates 1 include two valve diaphragms 4, one pumping diaphragm 5, a flow passage 12, and two fluid inlet and outlet ports 11, and are joined to both surfaces of a glass substrate 2 to constitute a pumping section 14 and a valve section 15. Also, the fluid inlet and outlet ports 11, the valve diaphragms 4, and the pumping diaphragm 5 are constructed to be connected to one another by the flow passage 12 formed on the silicon substrate 1.

In the embodiment, an elastic body is used to form packings 6 for blocking fluid flow, which packings are formed on the valve diaphragms 4 in the silicon substrate 1. The packings 6 are formed in the valve section 15 to assume a web, and have a thickness equal to or greater than an etching depth of the valve sections 15.

Therefore, the silicon substrates 1 and the glass substrate 2 are joined to each other to provide a construction, in which the packings 6 come into close contact with the glass substrate 2 to stem fluid flow within the valve section 15.

Also, connection ports 13 are formed midway between the packings 6 and the fluid inlet and outlet ports 11 in the glass substrate 2, and the silicon substrates 1 are joined to both surfaces of the glass substrate 2 to provide a construction in which the valve sections 15 disposed on the surfaces of the glass substrate 2 are connected to the fluid inlet and outlet ports 11 by means of the connection ports 13.

In the embodiment, both surfaces of silicon substrates having a thickness of 500 $\mu$m were subjected to anisotropic etching to form diaphragms having a thickness of 60 $\mu$m. Also, surfaces of silicon substrates being joined to the glass substrate were subjected to etching to a depth of 50 $\mu$m. The valve diaphragms had a planar size of 5×5 mm, and the pumping diaphragm had a planar size of 10×10 mm. Also, the glass substrate had a thickness of 300 $\mu$m, and the connection ports formed in the glass substrate had a diameter of 500 $\mu$m. The glass substrate was formed by sand blasting. Two silicon substrates and the glass substrate formed in this manner were overlapped on one another whereby the resulting product had a thickness of 1.3 mm as a whole.

The respective elements in the embodiment are sized as described above, but are not limited to the above-mentioned values, and appropriate values should be employed in accordance with a specification of a pump desired. Also, a method of processing is not limited to the above-mentioned one, but any method may be employed as long as it can manufacture the respective elements as required.

Also, piezoelectric elements 3 are provided on the valve diaphragms 4 and the pumping diaphragm 5 so that the bimorph effect of the diaphragms and the piezoelectric elements causes deformation of the diaphragms. In the embodiment, a piezoelectric bimorph is used as an actuator for deforming a diaphragm, while it is possible to use lamination type piezoelectric elements and shape memory alloy actuators. Also, it is possible to use electrostatic forces, magnetic forces, and air pressure, and so a method of deforming a diaphragm is not specifically limitative.

Subsequently, an explanation will be given to opening and closing of the valves with reference to FIG. 6.

Figure 6A:
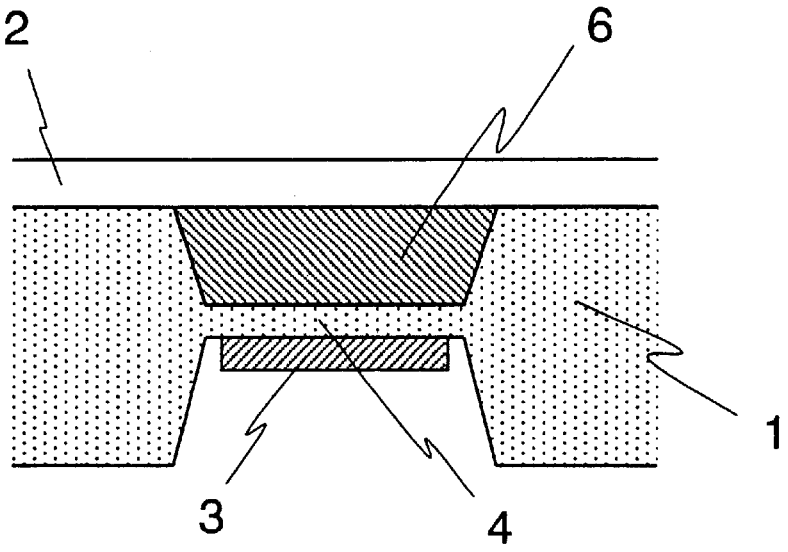
FIG. 6A is a cross sectional view showing a valve in closed state.

FIG. 6A is a vertical, cross sectional view showing fluid movements in the valve section. The packing 6 is existent between the glass substrate 2 and the valve diaphragms 4 to block flow in a direction perpendicular to the drawing.

In the embodiment, a bimorph type piezoelectric element is used as an actuator, in which case directions of displacement of the diaphragms can be varied by changing a direction of voltage applied on the piezoelectric elements.

Figure 6B:
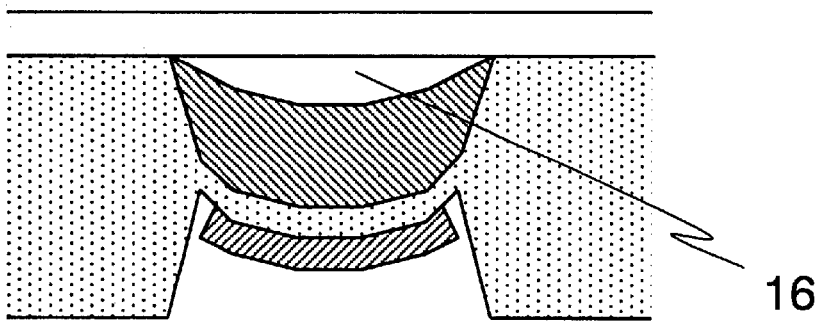
FIG. 6B is a cross sectional view showing the valve in opened state.

Hereupon, when the valve diaphragm 4 is displaced downward as shown in FIG. 6B, a gap 16 is generated between the packing 6 and the glass substrate 2, and the associated valve is put in an opened state by the passage of a fluid through the gap 16. When application of voltage is stopped, displacement of the valve diaphragm 4 disappears, so that the packing 6 being an elastic body comes into close contact with the glass substrate 2 to block movements of a fluid to put the associated valve in a closed state (FIG. 6A). In this manner, even in a state, in which the diaphragm does not displace, that is, any energy is not applied to the actuator, a closed state of the valve can be realized.

Figure 6C:
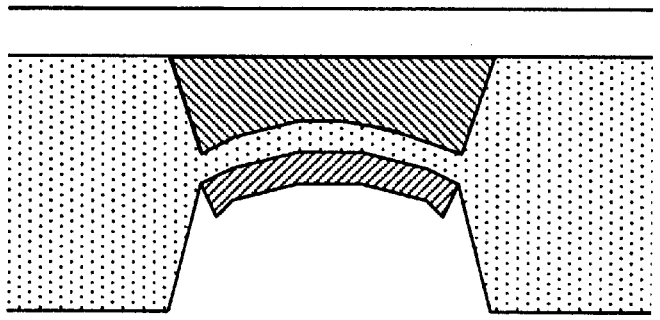
FIG. 6C is a cross sectional view showing a state in which a valve diaphragm is displaced to close the valve.

Further, the valve diaphragm 4 is made to displace upward as shown in FIG. 6C, and then it becomes possible to close the valve firmly.

As described above, opening and closing of the valves can be actively controlled in the pump of the invention.

Likewise, bimorph actuators cause the pumping diaphragm to displace to thereby change volumes of the pumping section to provide pumping motions.

As shown in FIG. 1, since the pumping section 14 and the valve section 15 are connected to each other by the flow passage 12, a combination of the opening and closing of the valves and the pumping motions can realize feeding of a liquid from the fluid inlet to the fluid outlet.

In the pump of the embodiment, the pumping section 14, the valve section 15 and the flow passage 12 are formed on both surfaces of the glass substrate 2. Thereby, a fluid sucked from the fluid inlet can follow two paths disposed on the both surfaces of the glass substrate 2.

More specifically, the two paths include a path, along which the fluid is drawn from the fluid inlet and discharged from the fluid outlet through the valve section, the pumping section and the valve section, and a path, along which the fluid is drawn from the fluid inlet and discharged from the fluid outlet through the connection ports, the valve section, the pumping section, the valve section, the connection ports and a path of the fluid outlet.

In this manner, the pump according to the invention is constructed such that the silicon substrates and the intermediate substrate are stacked on one another and through holes are present midway between the fluid inlet and outlet ports and the packings. Such through holes provide communication between the two paths and the valves are active valves capable of being optionally opened and closed by the actuators, whereby feeding of a liquid can be performed separately in the two paths on both surfaces of the glass substrate.

Accordingly, the two paths are separately used to enable realizing making an amount of liquid feeding per unit time two times larger without increasing the size of the pump. Also, since all the valves are always closed in a state, in which energy is not applied to the actuators, feeding of a liquid with high accuracy can be realized without being affected by pressures outside the pump. Also, since it is possible to optionally determine opening and closing of the respective valves and the pumping motion, feeding of a liquid in dual directions is made possible by changing the drive sequence.

Embodiment 2

A construction of a pump according to the embodiment will be described, in which a glass substrate is used as an intermediate substrate and silicon substrates are used as substrates being joined to both surfaces of the intermediate substrate and which comprises valve diaphragms and a pumping diaphragm on the silicon substrates, packings on the glass substrate and connection ports for connection of two valve sections.

Figure 7:
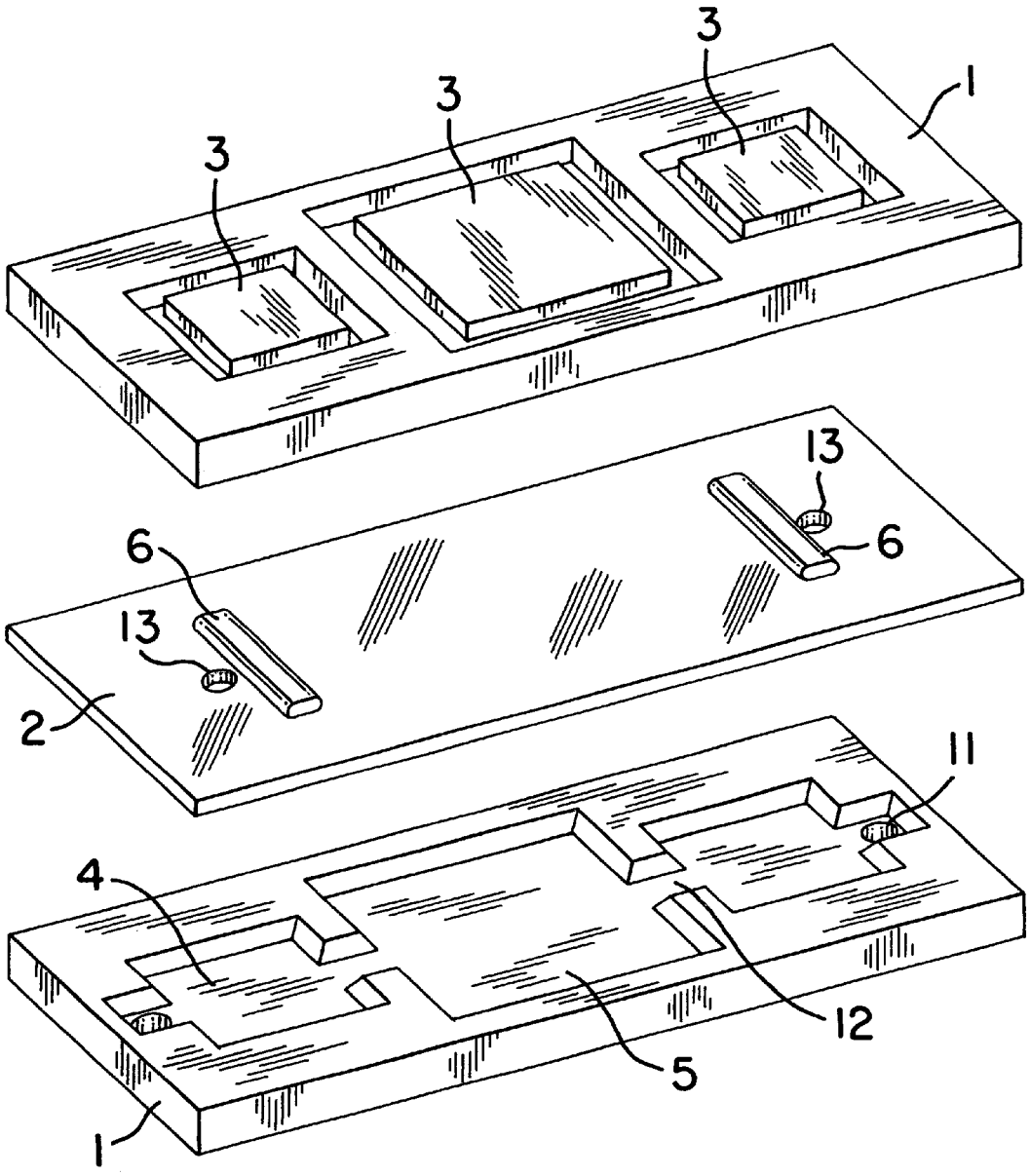
FIG. 7 is an exploded view showing an example of a pump according to the invention.

FIG. 7 is an exploded view showing a pump construction according to the invention. Two silicon substrates 1 include two valve diaphragms 4, one pumping diaphragm 5, a flow passage 12, and two fluid inlet and outlet ports 11, and are joined to both surfaces of a glass substrate 2 to constitute a pumping section 14 and a valve section 15. Also, the fluid inlet and outlet ports 11, the valve diaphragms 4, and the pumping diaphragm 5, respectively, are constructed to be connected to one another by the flow passage 12 formed on the silicon substrates 1.

In the embodiment, an elastic body is used to form packings 6 for blocking fluid flow, which packings 6 are formed on the glass substrate 2 to be positioned opposite to the valve diaphragms 4. The packings 6 are formed to assume a web, and have a thickness equal to or greater than an etching depth of the valve sections 15.

Therefore, the silicon substrates 1 and the glass substrate 2 are joined to each other to provide a construction, in which the packings 6 come into close contact with the valve diaphragms 4 to stem fluid flow within the valve section 15.

Also, connection ports 13 are formed midway between the packings 6 and the fluid inlet and outlet ports 11, and the silicon substrates 1 are joined to both surfaces of the glass substrate 2 to provide a construction, in which the valve sections 15 disposed on the both surfaces of the glass substrate 2 are connected to the fluid inlet and outlet ports 11 by means of the connection ports 13.

Various configurations are conceivable with respect to dimensions of and a processing method for the respective elements, and actuators for deforming the diaphragms, and can be used like those explained with respect to the embodiment 1.

Figure 8A:
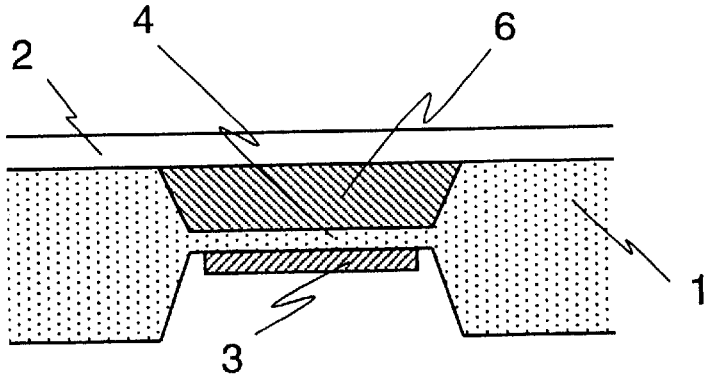
FIG. 8A is a cross sectional view showing a valve in closed state.
Figure 8B:
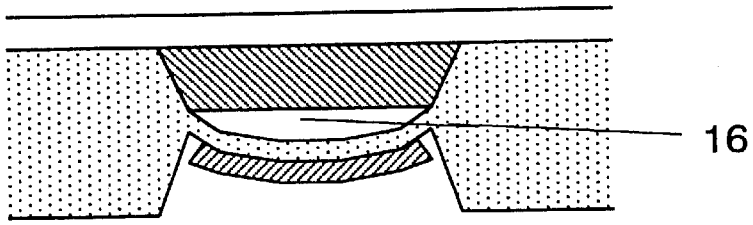
FIG. 8B is a cross sectional view showing the valve in opened state.

Also, when opening and closing of the valves is to be performed, the valve diaphragm 4 is displaced downward as shown in FIG. 8B, whereby a gap 16 is generated between the packing 6 and the valve diaphragm 4, and the associated valve is put in an opened state by the passage of a fluid through the gap 16. When application of voltage is stopped, displacement of the valve diaphragm 4 disappears, so that the packing 6 being an elastic body comes into close contact with the valve diaphragm 4 to block movements of a fluid to put the associated valve in a closed state (FIG. 8A).

Figure 8C:
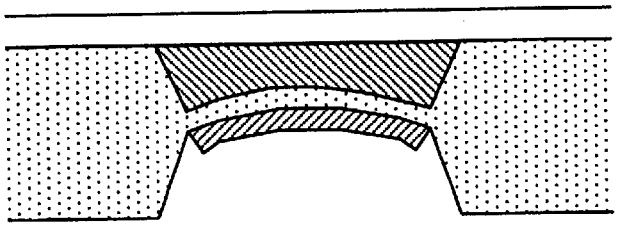
FIG. 8C is a cross sectional view showing a state in which a valve diaphragm is displaced to close the valve.

Further, the valve diaphragm 4 is made to displace upward as shown in FIG. 8C, and then it becomes possible to close the valve firmly.

As described above, opening and closing of the valves can be actively controlled in the pump of the invention. Likewise, bimorph actuators cause the pumping diaphragm to displace to thereby change volumes of the pumping section to provide pumping motions. Also, since the pumping section 14 and the valve section 15 are connected to each other by the flow passage 12, a combination of the opening and closing of the valves and the pumping motions can realize feeding of a liquid from the fluid inlet to the fluid outlet.

In the pump of the invention, the pumping section 14, the valve section 15, and the flow passage 12 are formed on both surfaces of the glass substrate 2, and so a fluid sucked from the fluid inlet can follow two paths disposed on the both surfaces of the glass substrate 2.

More specifically, the two paths include a path, along which the fluid is drawn from the fluid inlet and discharged from the fluid outlet through the valve section, the pumping section and the valve section, and a path, along which the fluid is drawn from the fluid inlet and discharged from the fluid outlet through the connection ports, the valve section, the pumping section, the valve section, the connection ports and a path of the fluid outlet.

In this manner, the pump according to the invention is constructed such that the silicon substrates and the intermediate substrate are stacked on one another and through holes are present midway between the fluid inlet and outlet ports and the packings. Such through holes provide communication between the two paths and the valves are active valves capable of being optionally opened and closed by the actuators, whereby feeding of a liquid can be performed separately in the two paths.

Accordingly, the two paths are separately used to enable realizing two times larger an amount of liquid feeding per unit time without increasing the planar size of the pump. Also, since all the valves are always closed in a state, in which energy is not applied to the actuators, feeding of a liquid with high accuracy can be realized without being affected by pressures outside the pump.

Also, an explanation has been given to the embodiment 1 with respect to an example, in which the packings are formed on the valve diaphragms, and an explanation has been given to the present embodiment with respect to an example, in which the packings are formed on the glass substrate. However, in the case where a construction is employed, in which the packings are separate from the valve diaphragms and the glass substrate, a similar effect can also be obtained. In this case, when bimorph actuators cause the valve diaphragms to deform, gaps, respectively, are produced between the packings and the valve diaphragms and between the packings and the glass substrate to thereby put the valves in an opened state.

Embodiment 3

In this embodiment, an explanation will be given to an example, in which in particular, any through holes serving as the fluid inlet and outlet ports are not formed in the silicon substrates 1 for the pumps in the embodiments 1 and 2.

Figure 9:
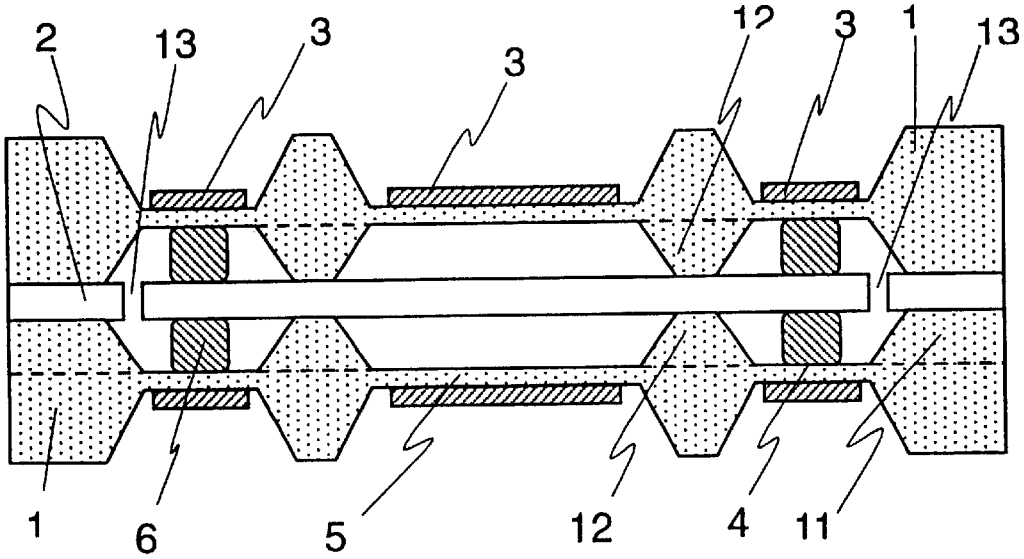
FIG. 9 is a cross sectional view showing an example of a pump according to the invention.

FIG. 9 is a cross sectional view showing an example of a pump construction according to the invention. Two silicon substrates 1, respectively, including two valve diaphragms 4, one pumping diaphragm 5 and a flow passage 12 are joined to both surfaces of a glass substrate 2 to constitute a pumping section 14 and a valve section 15. Also, the valve diaphragms 4 and the pumping diaphragm 5, respectively, are constructed to be connected to one another by the flow passage 12 formed on the silicon substrates 1. Further, the flow passage 12 reaches end surfaces of the silicon substrates 1 to form fluid inlet and outlet ports 11 on the sides of the pump.

Either of the methods described for the embodiments 1 and 2 can be applied to the valve construction in the present embodiment. Various configurations are also conceivable with respect to dimensions of and a processing method for the respective elements, and actuators for deforming the diaphragms, and can be used like those explained with respect to the embodiment 1. Therefore, the combination of the opening and closing motions of the valves by the valve diaphragms 4 and the pumping motions by the pumping diaphragm can realize feeding of a liquid from the fluid inlet to the fluid outlet. Also, the pumping section 14, the valve section 15, and the flow passage 12 are formed on both surfaces of the glass substrate 2, and so a fluid sucked from the fluid inlet can follow two paths disposed on the both surfaces of the glass substrate 2.

In this manner, the pump according to the invention is constructed such that the silicon substrates and the intermediate substrate are stacked on one another and through holes are present midway between the fluid inlet and outlet ports and the packings. Such through holes provide communication between the two paths and so feeding of a liquid can be performed separately in the two paths. Accordingly, it is possible to realize two times larger an amount of liquid feeding per unit time without increasing a size of the pump. Also, since all the valves are always closed in a state, in which energy is not applied to the actuators, feeding of a liquid with high accuracy can be realized without being affected by pressures outside the pump.

Further, when the pump construction according to the invention is used, there is no need of forming any through holes in the silicon substrates and the pump construction is such that the fluid inlet and outlet ports are present on the sides of the pump, whereby the pump is made advantageously simple in construction to make the manufacturing process easy.

Embodiment 4

In this embodiment, a construction of a pump will be described, in which two glass substrates formed with through holes and slots are joined to each other to be used as an intermediate substrate and silicon substrates are used as substrates being joined to both surfaces of the intermediate substrates and which comprises valve diaphragms, pumping diaphragms and fluid inlet and outlet ports formed on the silicon substrates, valve seats formed on the valve diaphragms, and packings formed on the valve seats.

Figure 10:
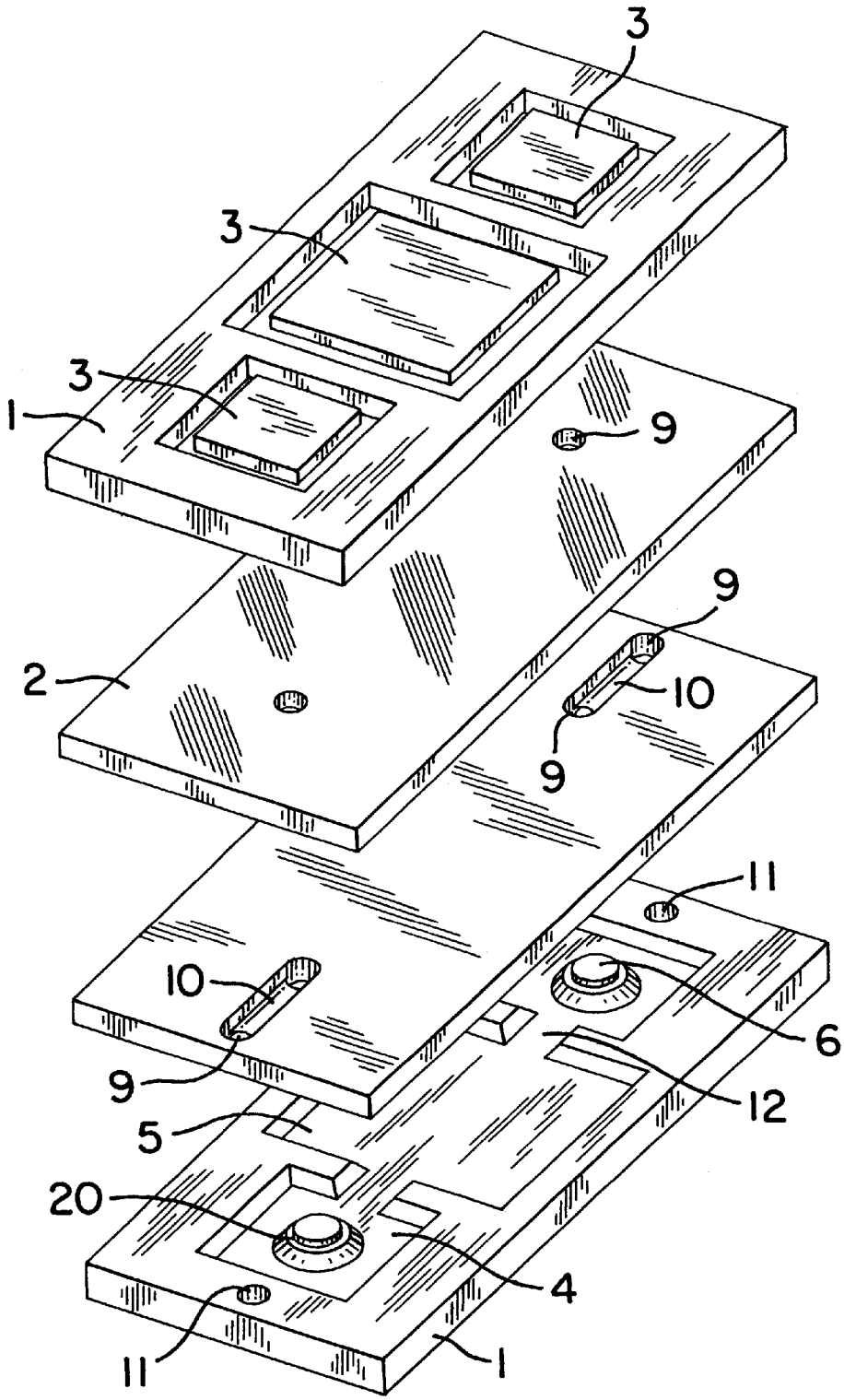
FIG. 10 is an exploded view showing an example of a pump according to the invention.
Figure 11:
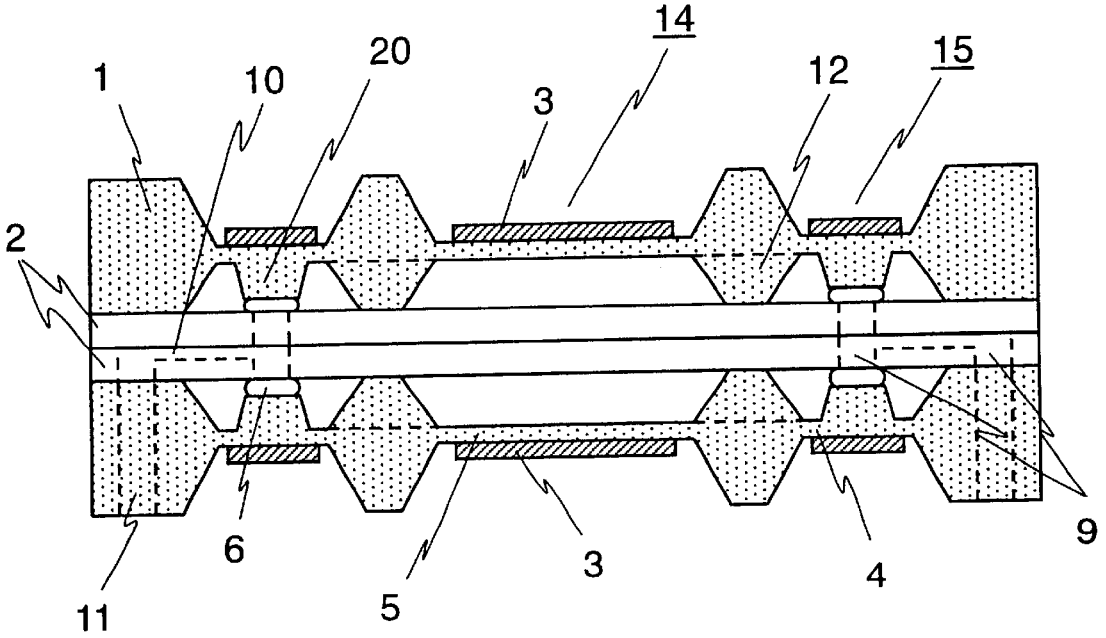
FIG. 11 is a cross sectional view showing an example of a pump according to the invention.

FIG. 10 is an exploded view showing a pump according to the present embodiment, and FIG. 11 is a cross sectional view showing the pump. Two glass substrates constituting the intermediate substrate are processed to be provided with slots and through holes, and are joined to each other to form the intermediate substrate having three branched flow passages.

Two silicon substrates 1 are joined to both surfaces of the intermediate substrate. Such joining causes two among the three branched flow passages to be directly closed by packings 6 formed on a diaphragm 4. Also, a through hole in the remaining one of the flow passages is connected to the fluid inlet and outlet ports 11 on the silicon substrates 1 as it is.

Various configurations are also conceivable with respect to dimensions of and a processing method for the respective elements, and actuators for deforming the diaphragms, and can be used like those explained with respect to the embodiment 1.

In addition, the respective diaphragms are deformed in the same manner as in the embodiment 1, and in the case where the valve diaphragm 4 is deformed in a direction opposite to the intermediate substrate, gaps are generated between the packings 6 and the through holes 9 to realize a state, in which the valves are opened. Also, deformation of the valve diaphragms toward the glass substrates makes it possible to close the valves firmly.

As described above, opening and closing of the valves can be actively controlled in the pump of the invention. Likewise, the pumping diaphragms are caused to displace to thereby change volumes of the pumping section to provide pumping motions. Also, a combination of the opening and closing motions of the valves and the pumping motions can realize feeding of a liquid from the fluid inlet to the fluid outlet.

With the pump in the present embodiment, the pumping section 14, the valve section 15, and the flow passage 12 are formed on both surfaces of the glass substrate 2 as shown in FIG. 11. Therefore, a fluid sucked from the fluid inlet can follow two paths disposed on the both surfaces of the intermediate substrate.

Also, the valves are active valves capable of being optionally opened and closed by the actuators, whereby feeding of a liquid can be performed separately in the two paths. Therefore, the two paths are separately used to enable realizing two times larger an amount of liquid feeding per unit time without increasing the size of the pump. Further, since all the valves are always closed in a state, in which energy is not applied to the actuators, feeding of a liquid with high accuracy can be realized without being affected by pressures outside the pump.

In the present embodiment, the valve seats are formed on the valve diaphragms and the packings are formed on the valve seats to close the through holes, but a similar effect can be obtained by using the method, in which any valve seats are not used and the packings are formed directly on the valve diaphragms like the embodiment 1.

Figure 12:
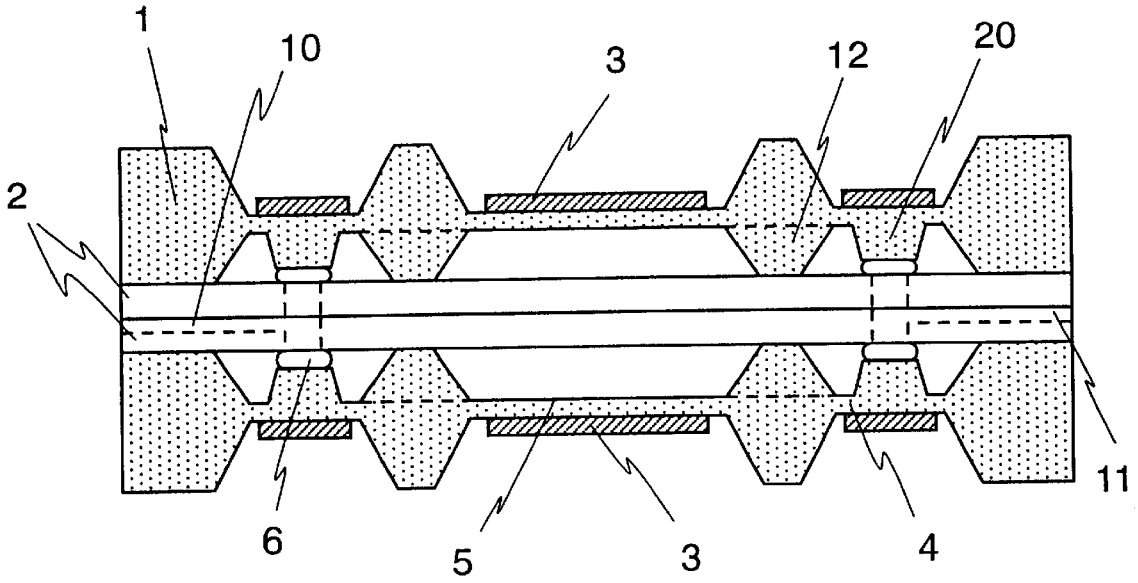
FIG. 12 is a cross sectional view showing an example of a pump according to the invention.

Also, as indicated in the embodiment 4, a similar effect can be obtained in a construction that the fluid inlet and outlet ports are disposed on the sides of the pump. FIG. 12 is a cross sectional view showing a construction of the pump in such case.

Embodiment 5

Subsequently, an explanation will be given to an example of a method of feeding a liquid in the pump of the present embodiment. While the construction of the pump described with respect to the embodiment 1 is used, other constructions can be used to realize a similar method of feeding a liquid.

Figure 13A:
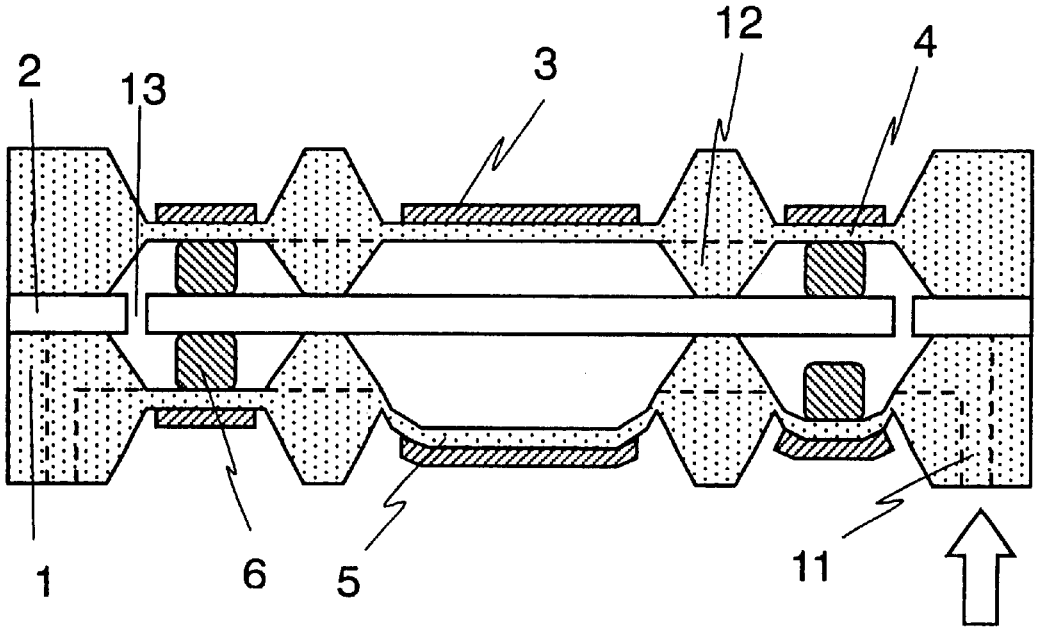
FIG. 13A is an illustration in the case where only one of the paths is used to draw a fluid.
Figure 13B:
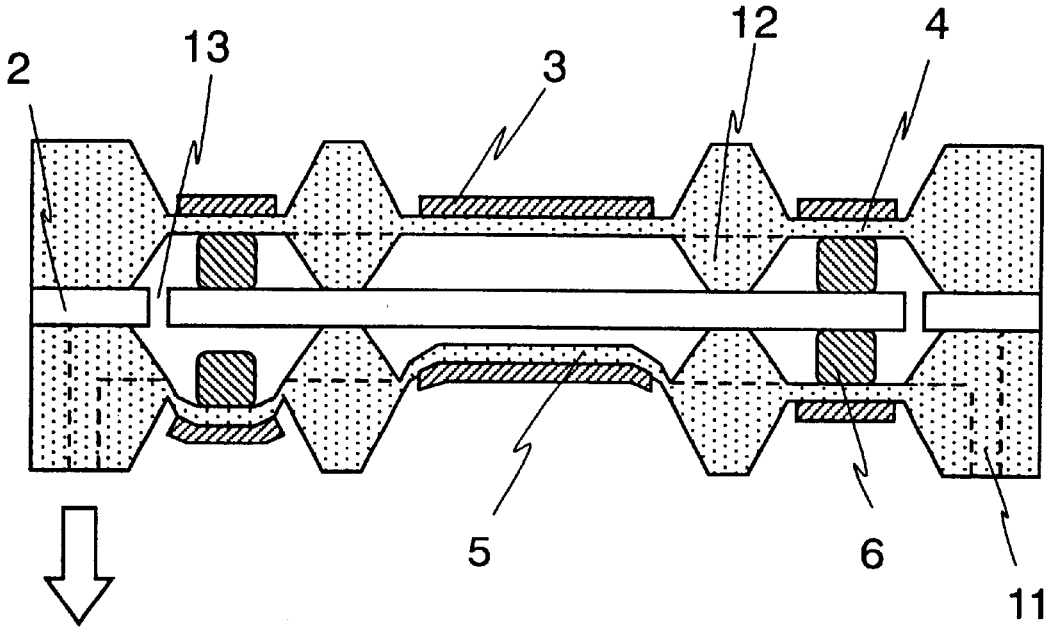
FIG. 13B is an illustration in the case where only one of the paths is used to discharge the fluid.

First, an explanation will be given to a liquid feeding method in the case where one of the two paths is used for liquid feeding, with reference to FIG. 13. As shown in FIG. 13A, a fluid is first drawn from the fluid inlet side by putting the suction side valve in an opened state and increasing a volume of the pumping section. Then, as shown in FIG. 13B, the fluid is discharged by closing the suction side valve, opening the discharge side valve and decreasing a volume of the pumping section. Liquid feeding from the inlet side to the outlet side is realized by repeating the above-mentioned two procedures of liquid feeding.

FIG. 14 is a graph indicating a change in displacement of the pumping diaphragm with time when liquid feeding is performed from the inlet side to the outlet side. Assuming that displacement of the diaphragm is zero when voltage is not applied to the bimorph actuators, displacement of the pumping diaphragm when the fluid is discharged is denoted to be plus, and displacement of the pumping diaphragm when the fluid is sucked is denoted to be minus. As shown in the figure, the pumping diaphragm will repeat cyclic motions at the time of liquid feeding. While the diaphragm performs symmetric motions in suction and discharge of the fluid with a neutral point corresponding to the case where voltage is not applied to the bimorph actuators, liquid feeding involves no problem provided that the pumping section undergoes change in volume even when displacement of the diaphragm is asymmetric at the time of suction and discharge.

Figure 16A:
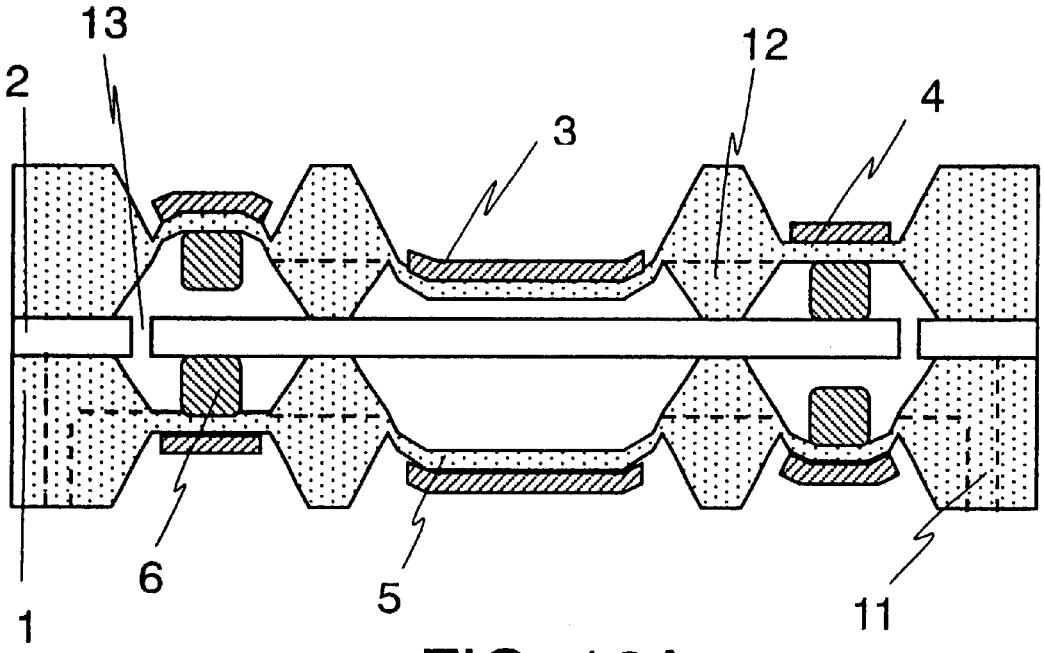
FIG. 16A is an illustration showing opening and closing of valves and pumping motions when one of two paths effects suction and the other of the paths effects discharge.
Figure 16B:
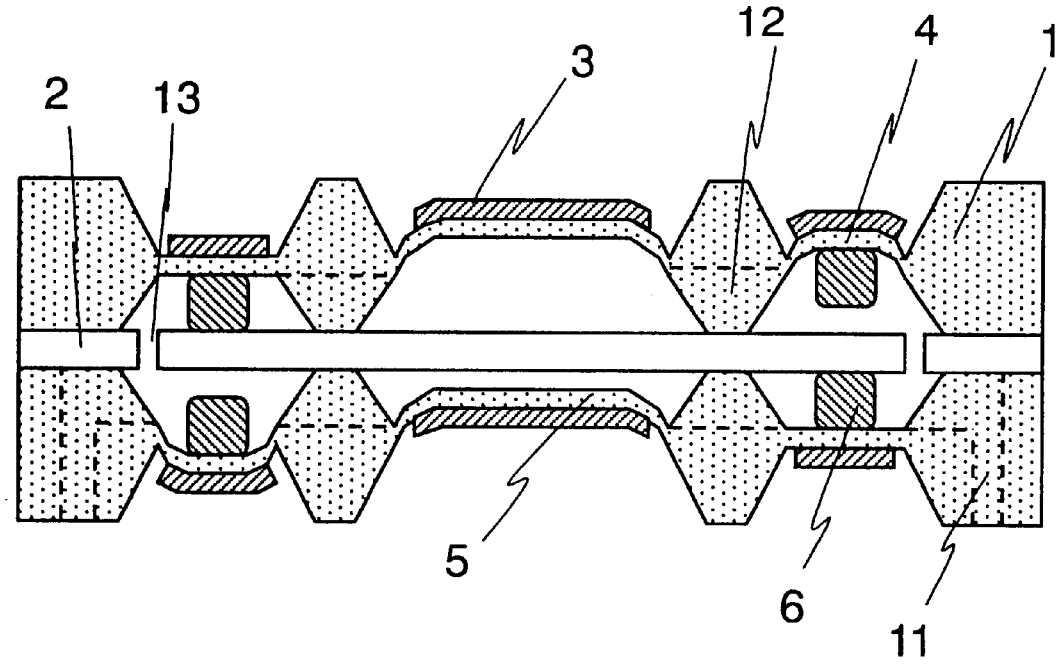
FIG. 16B is an illustration showing opening and closing of the valves and pumping motions when one of two paths effects discharge and the other of the paths effects suction.

FIG. 15A shows change in discharge with time in the case where the drive procedure shown in FIG. 13 is used. A path, which realized such liquid feeding, is assumed to be a path a. On the contrary, the other path disposed on the opposite side of the intermediate substrate is assumed to be a path b, liquid feeding in the path b is realized by the use of the above-mentioned procedure of liquid feeding. When liquid feeding is to be performed, however, driving is effected in such a manner to be reversed in phase relative to liquid feeding in the path a (that is, driving is such that when discharge is effected in the path a, suction is effected in the path b, and when suction is effected in the path a, discharge is effected in the path b). Thereby, liquid feeding is performed in the path b so that discharge shown in FIG. 15B is effected. In the case where liquid feeding is simultaneously performed through the above-mentioned two paths, opening and closing of the valves and pumping motions follow a procedure shown in FIG. 16. That is, as shown in FIGS. 16A and 16B, directions, in which the opposing diaphragms displace, become symmetric.

These two paths are connected to each other by way of through holes disposed midway between the packings and the fluid inlet and outlet ports and in the glass substrate, and are reversed in phase of the procedure of liquid feeding. Also, the valves are active valves capable of being optionally opened and closed by the actuators, whereby liquid feeding in the two paths can be performed separately from the fluid inlet side to the fluid outlet side at the same time without being affected by each other.

In this manner, a total discharge in the case where liquid feeding is simultaneously performed through the two paths becomes equal to a sum of those shown in FIGS. 15A and 15B, and so is as shown in FIG. 17. In FIG. 17, an amount of liquid feeding per unit time makes two times larger as compared with that in FIG. 15, and pulsating flow at the time of liquid feeding decreases. In this manner, an increase in an amount of liquid feeding per unit time and reduction in pulsating flow can be realized by reversing liquid feeding through the two paths in phase.

In addition, in the present embodiment, as shown in FIG. 16, an opening motion of the suction side valve and an action of increasing a volume of the pumping section are simultaneously performed in a first stage, and a closing motion of the suction side valve, an opening motion of the discharge side valve and an action of decreasing a volume of the pumping section are simultaneously performed in a second stage. However, a way to perform liquid feeding from the fluid inlet side to the fluid outlet side is not limited to the above-mentioned procedure of motion. For example, depending upon a difference in viscosity between fluids used and a difference in response between actuators used, liquid feeding with better efficiency can be realized by providing a lag in time between the opening and closing motions of the respective valves and the pumping motion.

While liquid feedings in the two paths are completely reversed in phase and the same is with drive frequency in the present embodiment, a drive method, in which an amount of liquid feeding and a spacing between pulsating flows are optimized, is not limited thereto. A difference in liquid feeding is in some cases caused depending upon line resistance and viscous resistance because the two paths are somewhat different in length. An amount of liquid feeding and pulsating flows can be optimized by changing phase and frequency of liquid feeding in the two paths. In particular, since active valves, which can be optionally opened and closed by the actuators, are used in the pump according to the present invention, the two paths are completely made independent. Therefore, optimization of amount of liquid feeding and pulsating flows is easy.

Also, the pump according to the present embodiment is constructed to be symmetric with respect to the two fluid inlet and outlet ports. Therefore, liquid feeding can be optionally selected in direction by shifting the order of driving of the respective actuators. In this manner, since the pump according to the present invention is constructed such that the through holes are provided midway between the packings and the fluid inlet and outlet ports and the two paths are connected to each other by the through holes, it is possible to independently perform liquid feeding in the respective paths. Accordingly, an amount of liquid feeding can be made two times larger by the use of two paths for liquid feeding.

Also, pulsating flows can be reduced at the time of liquid feeding by reversing the liquid feeding sequence in the two paths in phase.

Embodiment 6

A construction of a pump according to the present embodiment will be described, in which a glass substrate is used as an intermediate substrate and silicon substrates are used as substrates being joined to both surfaces of the intermediate substrate and in which pumping diaphragms formed on the silicon substrates define pumping sections, which are different in volume on the both surfaces of the intermediate substrate. In addition, while the construction of a valve section described with respect to the embodiment 1 is used in the present embodiment, valves of other constructions can be used to realize a similar effect.

FIG. 18 shows a construction, in cross section, of a pump according to the present embodiment. Pumping diaphragms in two silicon substrates 1 are different in etching depth. Thus a coarse movement pumping section 17 and a fine movement pumping section 18, which are different in volume, are formed when the silicon substrates 1 are joined to both surfaces of a glass substrate 2. When comparing the both with respect to volume, one having a small volume makes the fine movement pumping section. While such difference in volume can be readily set in accordance with etching depth on the silicon substrates 1, a method of processing the pumping diaphragms 5 is not limited to etching.

While the pump according to the present embodiment is displaced by actuators like in the embodiment 1, distances between the glass substrate 2 and the pumping diaphragms 5 in the fine movement pumping section 18 are smaller than displacements of the diaphragms caused by the actuators.

For example, with a bimorph type actuator composed of a silicon diaphragm and a piezoelectric element, displacements of the diaphragm are on the order of several tens of $\mu$m in the case where the silicon diaphragm has a size of 10×10 mm and a thickness of 60 $\mu$m and the piezoelectric element has a size of around 9×9 mm and a thickness of around 80 $\mu$m. In this case, distances between the glass substrate and the pumping diaphragms in the fine movement pumping section are assumed to be several $\mu$m.

Figure 19A:
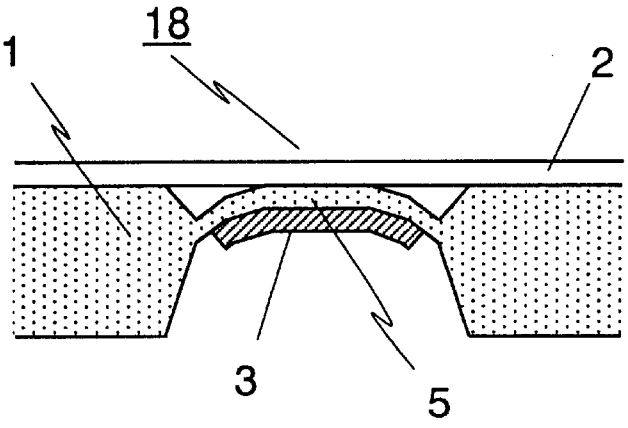
FIG. 19A is an illustration schematically showing displacement of a diaphragm in a fine movement pumping section.
Figure 19B:
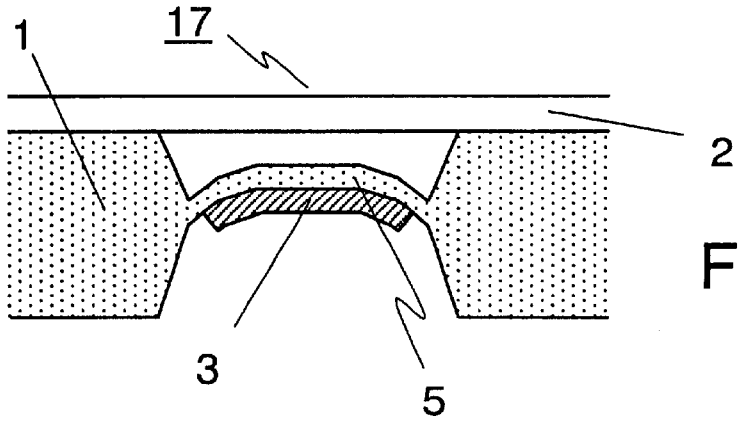
FIG. 19B is an illustration schematically showing displacement of a diaphragm in a coarse movement pumping section.

With such construction, when voltage is applied to the piezoelectric element 3 as shown in FIG. 19A, an amount of volumetric change in the fine movement pumping section 18 is limitative since displacement of the pumping diaphragm 5 is restricted by the glass substrate 2. Meanwhile, an amount of volumetric change in the coarse movement pumping section 17 is not limitative since a distance between the glass substrate 2 and the pumping diaphragm 5 in the coarse movement pumping section 17 is adequately ensured (FIG. 19B). With the two pumping sections of such construction, the coarse movement pumping section 17 and the fine movement pumping section 18 become different from each other in fluid discharge volume even when the same actuators are driven with the same voltage applied. Application of such construction on the pump according to the invention makes it possible for the two paths to be different in discharge volume per cycle even when the same voltage is applied to actuators having the same characteristics.

As described with respect to the embodiment 1, selection of the two liquid feeding paths can be optionally performed by selectively driving the respective actuators in the pump according to the invention. Thus, at least two liquid feeding paths can be selected depending upon use in such a manner that liquid feeding is performed by the coarse movement pumping section when a large amount of liquid feeding is desirable in a short time, and liquid feeding is performed by the fine movement pumping section when fine adjustment of discharge is needed.

With conventional pumps, voltage applied to respective actuators must be changed in value by the use of a voltage varying mechanism in order to change an amount of liquid feeding per cycle. Alternatively, it is necessary to use actuators having different displacements with the same voltage applied. Further, pumps making use of a one-way valve is problematic in that outside pressures change amounts of liquid feeding. However, pumps of the present construction make use of active valves, so that two liquid feeding paths are completely separate from each other and are divided into coarse movement pumping sections and fine movement pumping sections. Therefore, an amount of liquid feeding per cycle can be switched only by using actuators having the same characteristics and modifying the liquid feeding paths without any variation in values of voltage applied to the respective actuators.

Therefore, even when the same electric power source is used, an amount of liquid feeding per cycle can be changed only by making ON/OFF with a simple switch, which can make the entire system very simple. Also, the entire pumping system can be made small in size through simplification of a drive circuit. Further, low cost can be realized because actuators having the same characteristics can be used for the respective diaphragms.

Also, with the pump according to the present embodiment, the silicon substrate, which forms the coarse movement pumping section, and the silicon substrate, which forms the fine movement pumping section, are separate from each other. Therefore, even in the case where the coarse movement pumping section and the fine movement pumping section should be made different in etching depth, it suffices that the respective silicon substrates be processed in separate processes, which makes a manufacturing process easy.

Embodiment 7

A construction of a pump according to the present embodiment will be described, in which a glass substrate is used as an intermediate substrate and silicon substrates are used as substrates being joined to both surfaces of the intermediate substrate and in which pumping diaphragms formed on the two silicon substrates are different from each other in thickness. In addition, while the construction of a valve section described with respect to the embodiment 1 is used in the present embodiment, valves of other constructions can be used to realize a similar effect.

Figure 20:
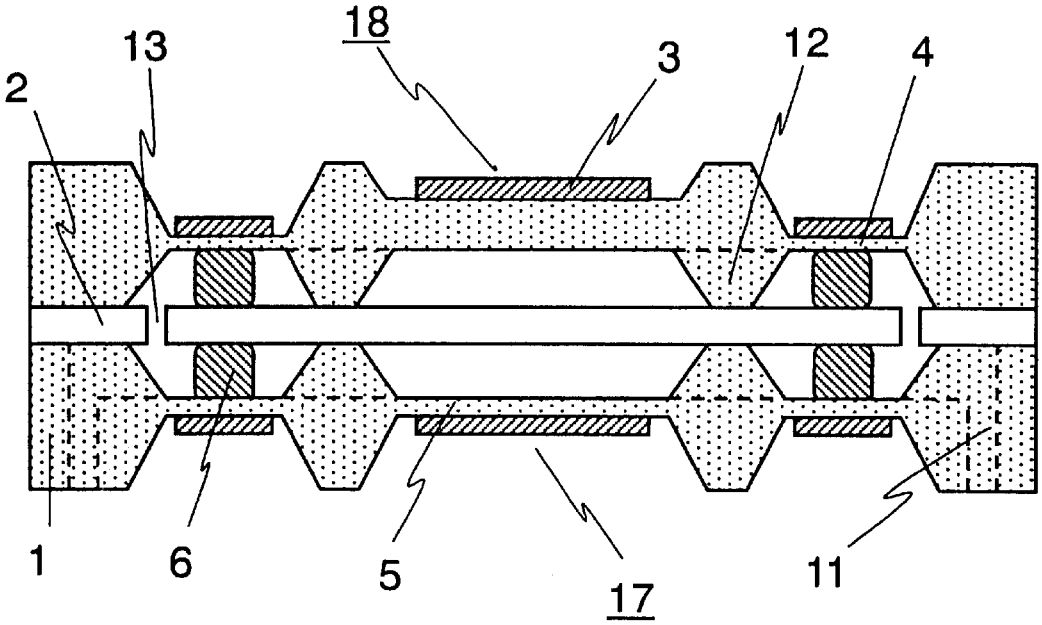
FIG. 20 is a cross sectional view showing a constitution of a pump having two paths, in which pumping diaphragms are different in thickness.

FIG. 20 is a cross sectional view showing an example of a pump construction according to the present embodiment, in which construction pumping diaphragms 5 formed on two silicon substrates 1 are different from each other in thickness.

Figure 21A:
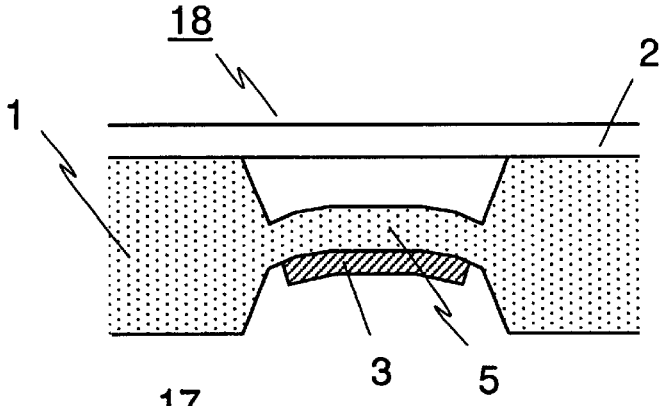
FIG. 21A is an illustration schematically showing displacement of a diaphragm in a fine movement pumping section.
Figure 21B:
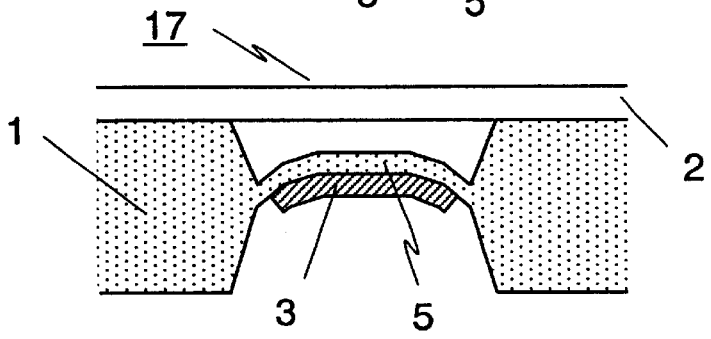
FIG. 21B is an illustration schematically showing displacement of a diaphragm in a coarse movement pumping section.

As described with respect to the embodiment 1, actuators act to deform the pumping diaphragms, and with the use of the same actuators, the pumping diaphragms are different in displacement depending upon the thicknesses of the diaphragms. For example, with the construction of a pump shown in FIG. 20, the fine movement pumping section 18 has a thicker pumping diaphragm than that of the coarse movement pumping section 17. Therefore, as shown in FIG. 21, in the case where the same driving is performed by actuators having the same performance, the fine movement pumping section 18 shown in FIG. 21A becomes smaller in discharge volume than the coarse movement pumping section 17 shown in FIG. 21B.

Application of such construction on the pump according to the invention makes it possible for the two paths to be different in discharge volume per cycle even when the same voltage is applied to the same actuators.

As described with respect to the embodiment 1, selection of the two liquid feeding paths can be optionally performed by changing the drive sequence of the respective actuators in the pump according to the invention. Thus, at least two liquid feeding paths can be selected depending upon use in such a manner that liquid feeding is performed by the coarse movement pumping section when a large amount of liquid feeding is desirable in a short time, and liquid feeding is performed by the fine movement pumping section when fine adjustment of discharge is needed.

With conventional pumps, voltage applied to respective actuators must be changed in value by the use of a voltage varying mechanism in order to change an amount of liquid feeding per cycle. Alternatively, it is necessary to use actuators having different displacements with the same voltage applied. Further, pumps making use of a one-way valve is problematic in that outside pressures change amounts of liquid feeding. However, pumps of the present construction make use of active valves, so that two liquid feeding paths are completely separate from each other and are divided into coarse movement pumping sections and fine movement pumping sections. Therefore, an amount of liquid feeding per cycle can be switched only by using actuators having the same characteristics and modifying the liquid feeding paths without any variation in values of voltage applied to the respective actuators.

Therefore, even when the same electric power source is used, an amount of liquid feeding per cycle can be changed only by making ON/OFF with a simple switch, which can make the entire system very simple. Also, the entire pumping system can be made small in size through simplification of a drive circuit. Further, low cost can be realized because actuators having the same characteristics can be used for the respective diaphragms.

Also, with the pump according to the present invention, the silicon substrate, which forms the coarse movement pumping section, and the silicon substrate, which forms the fine movement pumping section, are separate from each other. Therefore, even in the case where the coarse movement pumping section and the fine movement pumping section should be made different in etching depth, it suffices that the respective silicon substrates be processed in separate processes, which makes a manufacturing process very easy.

Embodiment 8

In this embodiment, an explanation will be given to an example in which a pump system comprises a plurality of pumps each having two separate paths described in the embodiment 1 are stacked.

Figure 22:
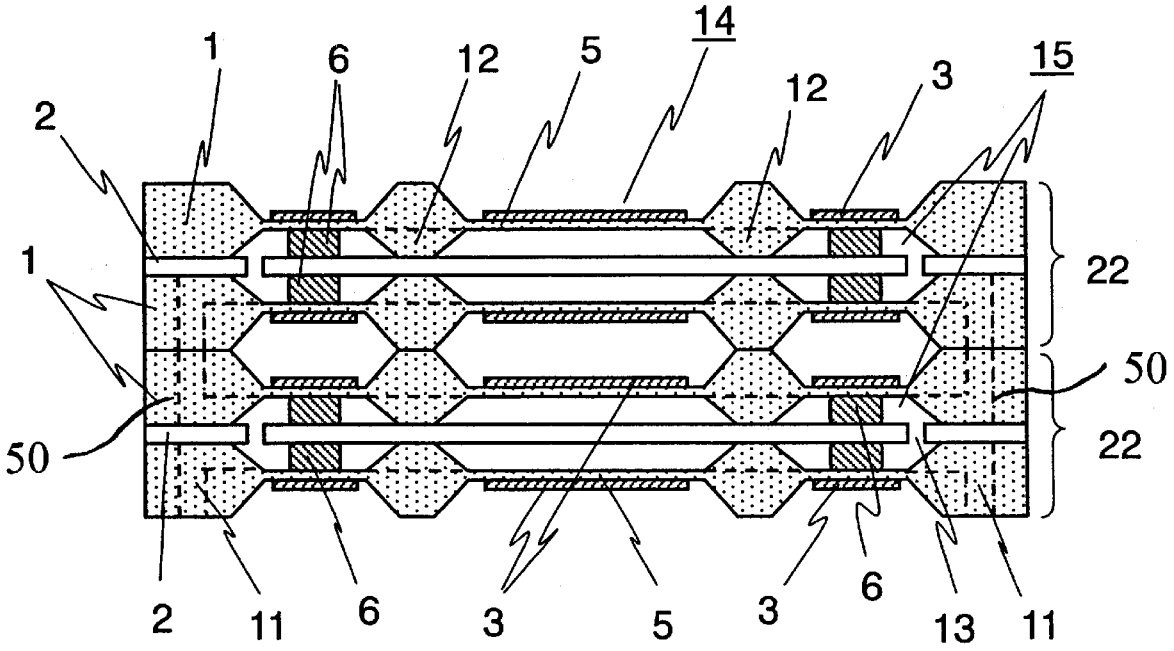
FIG. 22 is a cross sectional view showing a constitution of a pump, in which two fundamental units are stacked on each other.

First, with the pump described in the embodiment 1 being a fundamental unit, the pump system comprises a plurality of such fundamental units stacked on one another in such a manner that respective fluid inlets and respective fluid outlets are connected to one another via connection ports 50. FIG. 22 is a cross sectional view. Here, while two fundamental units are stacked on one another in such a manner that a fluid inlet and a fluid outlet, respectively, in the fundamental unit 22 are connected to those in another fundamental unit, at least one of the fundamental units must have fluid inlet and outlet ports for communication between an interior of the pump and the outside. Such pump includes two separate liquid feeding paths in every fundamental unit, and so includes four separate liquid feeding paths in total because two fundamental units are stacked on one another. Therefore, an amount of liquid feeding can be made four times larger as compared with conventional pumps.

Also, in the present embodiment, when the fundamental units 22 are stacked on one another, it becomes difficult to supply energy to actuators, which are disposed on surfaces where the respective fundamental units 22 are joined to one another, so that silicon substrates 1 on the joined surfaces are formed with grooves, through which cords for supplying of energy pass. Also, these grooves serve to prevent generation of completely sealed spaces when the two fundamental units 22 are joined to each other. When opposed actuators are driven in the completely sealed spaces, there is caused the possibility that movements of one of the actuators affect movements of the other of the actuators, but there will not be caused such problem provided that such grooves are present. Of course, it does not matter whether such grooves are present or not in the case where there is caused no problem with respect to supplying of energy and interference of actuators.

Also, while the embodiment 5 has been described with respect to an example, in which pulsating flows are reduced by shifting liquid feeding in the two liquid feeding paths in phase, pulsating flows can be further reduced in the pump according to the present embodiment by shifting liquid feeding in the four liquid feeding paths, respectively, in phase.

In addition, while the present embodiment has been described with respect to an example, in which two fundamental units are stacked on one another, the number of fundamental units stacked can be optional and, as such number increases, an amount of liquid feeding increases and pulsating flows are reduced contrary thereto.

In this manner, it becomes possible in the present embodiment to increase an amount of liquid feeding and decrease pulsating flows without increasing the planar size of the pump.

Embodiment 9

In this embodiment, an explanation will be given to an example, in which a pump with two fundamental units stacked is used like the embodiment 8 and respective pumping diaphragms are varied in thickness and etching depth.

In the above-mentioned embodiments 6 and 7, an explanation has been given to a method of forming a coarse movement pumping section and a fine movement pumping section by changing thicknesses of pumping diaphragms and volumes of pumping sections for the substrates A and B.

A pump according to the present embodiment includes four separate liquid feeding paths. These respective paths include paths A, B, C and D. Thicknesses of pumping diaphragms were adjusted so that when voltage of 100 V was applied to the respective actuators, amounts of liquid feeding per cycle were 1 micro liter, 2 micro liters, 4 micro liters, and 8 micro liters. Switching of amounts of liquid feeding in fifteen stages is possible by performing liquid feeding by the use of at least one of these paths. For example, the use of the paths A and B enables liquid feeding of 3 micro liters, and the use of the paths A, B and C enables liquid feeding of 7 micro liters. FIG. 23 shows combinations in switching of 1 to 15 micro liters in fifteen stages.

With conventional pumps, voltage applied to respective actuators must be changed in value by the use of a voltage varying mechanism in order to change an amount of liquid feeding per cycle. Alternatively, it is necessary to use actuators having different characteristics. Therefore, the pumps involve a problem in complexity of the system and an increased cost. With the pump having the above-mentioned construction, however, an amount of liquid feeding per cycle can be changed in fifteen stages only by using the same actuators and combining the liquid feeding paths without changing voltage applied in value. In this case, the entire system can be made very simple by using the same actuators and the same voltage source and making ON/OFF with a simple switching. Also, the entire pumping system can be made small in size and low cost can be realized through simplification of a drive circuit.

In addition, while the respective pumping diaphragms in the present embodiment are adjusted in thickness in order to change an amount of liquid feeding per cycle in the respective paths, a pump having a similar effect can be realized by adjusting a volume of the pumping section as in the embodiment 6.

In addition, while the present embodiment has been described with respect to an example, in which two fundamental units are stacked on one another, the number of fundamental units stacked can be optional and, as such number increases, an amount of liquid feeding can be switched to other stages.

The present embodiment has been described with respect to an example, in which separate paths are four in number. It is to be noted that in the case where separate paths are n in number, switching of an amount of liquid feeding in $(2^0+2^1+2^2+\ldots+2^{n-1})$ stages can be realized by making ON/OFF by means of a simple switch without the use of any voltage varying mechanism where amounts of liquid feeding per cycle in the respective paths are $2^0, 2^1, 2^2, \ldots 2^{n-1}$ micro liters.

Since the pump according to the invention is constructed such that active valves are used and two completely separate paths are stacked vertically, it can be enhanced in liquid feeding capacity to two times larger without an increase in size of the entire pump. Also, an interval between pulsating flows at the time of liquid feeding can be reduced by reversing the liquid feeding sequence in the two paths in phase.

Meanwhile, an amount of liquid feeding per cycle can be switched only by using the same actuators and modifying the liquid feeding paths without changing voltage value applied, on condition that the two pumping sections are made different in volume from each other or the pumping diaphragms are made different in thickness. Since an amount of liquid feeding of the pump can be switched without the use of any variable electric power source, the entire system containing an electric power source can be made very small and simple.

Also, all the above-mentioned features can be improved with the pump constant in planar size by forming the pump from a plurality of fundamental units, each being a pump.

What is claimed is:

1. A pump comprising: a first substrate having a fluid inlet port for receiving a fluid, a fluid outlet port for discharging the fluid, a first pumping section having a first pumping actuator and a first pumping diaphragm for pumping the fluid, a first inlet valve section disposed between the fluid inlet port and the first pumping section and having a first inlet valve diaphragm and a first inlet valve actuator and a first inlet packing member disposed on opposite surfaces of the first inlet valve diaphragm, and a first outlet valve section disposed between the fluid outlet port and the first pumping section and having a first outlet valve diaphragm and a first outlet valve actuator and a first outlet packing member disposed on opposite surfaces of the first outlet valve diaphragm; a second substrate having a second pumping section having a second pumping actuator and a second pumping diaphragm for pumping the fluid, a second inlet valve section having a second inlet valve diaphragm and a second inlet valve actuator and a second inlet packing member disposed on opposite surfaces of the second inlet valve diaphragm, and a second outlet valve section having a second outlet valve diaphragm and a second outlet valve actuator and a second outlet packing member disposed on opposite surfaces of the second outlet valve diaphragm; and an intermediate substrate disposed between the first and second substrates to form a first fluid feeding path and a second fluid feeding path for feeding the fluid pumped by the first and second pumping sections, the first fluid feeding path extending from the first inlet valve section to the first outlet valve section through the first pumping section, and the second fluid feeding path extending from the second inlet valve section to the second outlet valve section through the second pumping section, the intermediate substrate having a first connection port connecting the first and second inlet valve sections in fluid communication with the fluid inlet port and a second connection port connecting the first and second outlet valve sections in fluid communication with the fluid outlet port.

2. A pump according to claim 1; wherein the first pumping section has a first fluid discharge volume when a given voltage is applied to the first pumping actuator; and wherein the second pumping section has a second fluid discharge volume different from the first fluid discharge volume when the given voltage is applied to the second pumping actuator.

3. A pump according to claim 1; wherein a fluid discharge volume of the first pumping section is different from a fluid discharge volume of the second pumping section.

4. A pump according to claim 1; wherein a thickness of the first pumping diaphragm is different from a thickness of the second pumping diaphragm.

5. A pump according to claim 4; wherein a fluid discharge volume of the first pumping section is different from a fluid discharge volume of the second pumping section.

6. A pump system comprising: at least two pumps according to claim 1 comprised of first and second pumps, respectively, stacked over one another so that the fluid inlet port and the fluid outlet port of the first pump are in fluid communication with a respective one of the fluid inlet port and the fluid outlet port of the second pump.

7. A pump system according to claim 6; wherein the second substrate of the first pump is disposed between the second substrate of the first pump and the first substrate of the second pump, the second substrate of the first pump having a first connection port connecting the fluid inlet port of the second pump in fluid communication with the fluid inlet port of the first pump and a second connection port connecting the fluid outlet port of the second pump in fluid communication with the fluid outlet port of the first pump.

8. A pump system according to claim 6; wherein the first and second pumps are stacked in a direction generally perpendicular to a major surface of each of the first and second substrates.

9. A method of driving a pump, comprising the steps of: providing a pump according to claim 1; drawing a fluid from the fluid inlet port by applying a voltage to the first inlet valve actuator to deform the first inlet valve diaphragm from an undeformed state to thereby open the first inlet valve section; applying a voltage to the first pumping actuator to extend the first pumping diaphragm in a direction away from the intermediate substrate to thereby increase a volume of fluid in the first pumping section; closing the first inlet valve section by releasing the voltage applied to the first inlet valve actuator to return the first inlet valve diaphragm to the undeformed state; opening the first outlet valve section by applying a voltage to the first outlet valve actuator to deform the first outlet valve diaphragm from an undeformed state; discharging the fluid from the fluid outlet port by applying a voltage to the first pumping actuator to extend the first pumping diaphragm in a direction towards the intermediate substrate to thereby decrease the volume of the fluid in the first pumping section; and closing the first outlet valve section by releasing the voltage applied to the first outlet valve actuator to return the first outlet valve diaphragm to the undeformed state.

10. A pump comprising: a first substrate having a fluid inlet port for receiving a fluid, a fluid outlet port for discharging the fluid, a first pumping section for pumping the fluid from the fluid inlet port to the fluid outlet port, a first inlet valve section disposed between the fluid inlet port and the first pumping section, and a first outlet valve section disposed between the fluid outlet port and the first pumping section; a second substrate having a second pumping section for pumping the fluid from the fluid inlet port to the fluid outlet port, a second inlet valve section, and a second outlet valve section; and an intermediate substrate disposed between the first and second substrates to form two fluid feeding paths for feeding the fluid pumped by the first and second pumping sections from the fluid inlet port to the fluid outlet port.

11. A pump according to claim 10; wherein the two fluid feeding paths comprise a first fluid feeding path extending from the first inlet valve section to the first outlet valve section through the first pumping section and a second fluid feeding path extending from the second inlet valve section to the second outlet valve section through the second pumping section.

12. A pump according to claim 11; wherein the intermediate substrate has a first connection port connecting the first and second inlet valve sections in fluid communication with the fluid inlet port and a second connection port connecting the first and second outlet valve sections in fluid communication with the fluid outlet port.

13. A pump according to claim 10; wherein a fluid discharge volume of the first pumping section is different from a fluid discharge volume of the second pumping section.

14. A pump system comprising: at least two pumps according to claim 10 comprised of first and second pumps, respectively, stacked over one another so that the fluid inlet port and the fluid outlet port of the first pump are in fluid communication with a respective one of the fluid inlet port and the fluid outlet port of the second pump.

15. A pump system according to claim 14; wherein the second substrate of the first pump is disposed between the second substrate of the first pump and the first substrate of the second pump, the second substrate of the first pump having a first connection port connecting the fluid inlet port of the second pump in fluid communication with the fluid inlet port of the first pump and a second connection port connecting the fluid outlet port of the second pump in fluid communication with the fluid outlet port of the first pump.

16. A pump system according to claim 14; wherein the first and second pumps are stacked in a direction generally perpendicular to a major surface of each of the first and second substrates.

* * * * *